US009662896B2

(12) United States Patent
Yamada

(10) Patent No.: US 9,662,896 B2
(45) Date of Patent: May 30, 2017

(54) PROTECTION MEMBER AND LIQUID SUPPLY UNIT SET

(71) Applicant: Seiko Epson Corporation, Tokyo (JP)

(72) Inventor: Manabu Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/959,357

(22) Filed: Dec. 4, 2015

(65) Prior Publication Data

US 2016/0159101 A1 Jun. 9, 2016

(30) Foreign Application Priority Data

Dec. 8, 2014 (JP) ..... 2014-247691

(51) Int. Cl.

| | |
|---|---|
| ***B41J 2/175*** | (2006.01) |
| ***B41J 29/02*** | (2006.01) |
| ***B41J 29/13*** | (2006.01) |
| ***B41J 2/165*** | (2006.01) |

(52) U.S. Cl.

CPC ..... *B41J 2/17536* (2013.01); *B41J 2/16508* (2013.01); *B41J 2/1752* (2013.01); *B41J 2/1753* (2013.01); *B41J 2/17513* (2013.01); *B41J 2/17553* (2013.01); *B41J 29/02* (2013.01); *B41J 29/13* (2013.01)

(58) Field of Classification Search

CPC .. B41J 2/17536; B41J 2/1753; B41J 2/17553; B41J 2/1752

See application file for complete search history.

(56) References Cited

U.S. PATENT DOCUMENTS

| | | | | |
|---|---|---|---|---|
| 5,831,652 | A * | 11/1998 | Hinami | B41J 2/17513 206/497 |
| 7,380,919 | B1 * | 6/2008 | Anderson | B41J 2/17536 347/108 |
| 8,172,386 | B2 | 5/2012 | Petranek et al. | |
| 2013/0063519 | A1 * | 3/2013 | Wall | B41J 2/16505 347/32 |

FOREIGN PATENT DOCUMENTS

| | | | |
|---|---|---|---|
| JP | 08-112915 | A | 5/1996 |

* cited by examiner

*Primary Examiner* — Juanita D Jackson
(74) *Attorney, Agent, or Firm* — Workman Nydegger

(57) ABSTRACT

A cap attached to an ink supply unit that supplies ink to a liquid ejection apparatus is provided. The cap has a sealing portion adapted to seal a liquid supply portion of the ink supply unit and an engagement portion adapted to engage with the engaging portion of the ink supply unit. The cap also has an opening provided in a portion opposed to the terminal portion of the ink supply unit such that at least a part of the terminal portion is exposed through the opening in a state where the protection member is attached to the liquid supply unit.

10 Claims, 27 Drawing Sheets

PROTECTION MEMBER AND LIQUID SUPPLY UNIT SET

BACKGROUND

1. Technical Field

The present invention relates to protection members, liquid supply unit sets, and the like.

2. Related Art

In an inkjet printer, which is an exemplary liquid ejection apparatus, printing media such as printing paper is printed onto by discharging ink, which is exemplary liquid, onto the printing media from a print head. Inkjet printers are known to which ink is supplied from ink cartridges, which are exemplary liquid supply units. Ordinarily, an ink cartridge includes a liquid containing portion adapted to contain ink, and a liquid supply portion adapted to supply the ink in the liquid containing portion to the inkjet printer. Hitherto, an ink cartridge is known to which, before being attached to the inkjet printer, a protection member (cap) for sealing the liquid supply portion is attached (e.g., see JP-A-8-112915).

With the protection member described in JP-A-8-112915 mentioned above, leakage of the ink from the liquid supply portion can be suppressed. Meanwhile, some kinds of ink cartridges have an electrical circuit provided with a terminal portion adapted to be electrically connected to a control circuit of an inkjet printer. For an ink cartridge having such an electrical circuit, there are cases where an electrical test is conducted on the electrical circuit by sending and receiving various electrical signals to and from the electrical circuit via the terminal portion. In the case where the protection member described in JP-A-8-112915 is applied to an ink cartridge having this terminal portion, if the terminal portion is hidden by the protection member, the electrical test cannot be conducted in a state where the protection member is attached to the ink cartridge in some cases. This problem is not considered regarding the protection member described in JP-A-8-112915. Thus, there is room for further improvement in the known protection member.

SUMMARY

The invention can solve at least the foregoing problem, and can be achieved as the following modes or application examples.

Application Example 1

One application example of a protection member adapted to be attached to a liquid supply unit that can supply liquid to a liquid ejection apparatus is provided. The liquid supply unit includes: a liquid supply portion adapted to supply the liquid to a liquid ejection apparatus; a terminal portion adapted to be electrically connected to an electrical connection portion provided in the liquid ejection apparatus; and an engaging portion adapted to engage with the liquid ejection apparatus. The protection member includes: a sealing portion adapted to seal the liquid supply portion; and an engagement portion adapted to engage with the engaging portion, and an opening provided in a portion opposed to the terminal portion such that at least a part of the terminal portion is exposed through the opening in a state where the protection member is attached to the liquid supply unit.

With the protection member in this application example, when the protection member is attached to the liquid supply unit, the terminal portion can be easily protected by the portion opposed to the terminal portion. In addition, with this protection member, when the protection member is attached to the liquid supply unit, at least a part of the terminal portion of the liquid supply unit is exposed via the opening of the protection member. For this reason, the terminal portion of the liquid supply unit can be touched via the opening in a state where the protection member is attached to the liquid supply unit. As a result, for example, an electrical test can be conducted via the terminal portion in a state where the protection member is attached to the liquid supply unit.

Application Example 2

In the above protection member, when the terminal portion is viewed via the opening in a state where the protection member is attached to the liquid supply unit, at least a part of the engagement portion may be located within a region formed by extending the opening in a direction extending from the sealing portion toward the liquid supply portion.

In this application example, the position accuracy of the opening relative to the terminal portion can be easily increased compared with the case where the engagement portion is located out of the region formed by extending the opening in the direction from the sealing portion toward the engagement portion.

Application Example 3

Another application example of a protection member adapted to be attached to a liquid supply unit is provided. The another application example example of the liquid supply unit includes a first partition wall having a supply hole adapted to supply a liquid to a liquid ejection apparatus; a second partition wall intersecting the first partition wall, the second partition wall having a terminal portion adapted to be electrically connected to an electrical connection portion provided in the liquid ejection apparatus and having a first engaging portion adapted to engage with the liquid ejection apparatus; and a third partition wall intersecting the first partition wall and opposed to the second partition wall, the third partition wall having a second and third engaging portions adapted to engage with the liquid ejection apparatus respectively. The protection member includes: a bottom wall having a sealing portion adapted to seal the supply hole; a first side wall intersecting the bottom wall, the first side wall having a first engagement portion adapted to engage with the first engaging portion, and having an opening provided in a portion opposed to the terminal portion so that at least a part of the terminal portion is exposed through the opening in a state where the protection member is attached to the liquid supply unit.

With the protection member in this application example, when the protection member is attached to the liquid supply unit, the terminal portion can be easily protected by the portion opposed to the terminal portion. In addition, with this protection member, when the protection member is attached to the liquid supply unit, at least a part of the terminal portion of the liquid supply unit is exposed via the opening of the protection member. For this reason, the terminal portion of the liquid supply unit can be touched via the opening in a state where the protection member is attached to the liquid supply unit. As a result, for example, an electrical test can be conducted via the terminal portion in a state where the protection member is attached to the liquid supply unit.

Application Example 4

The above protection member may further includes a second side wall intersecting the bottom wall and opposed to the first side wall, and a second and a third engagement portions adapted to engage with the second and the third engaging portions, respectively. The second and the third engagement portions may be provided on the second side wall.

In this application example, the position accuracy of the opening relative to the terminal portion can be increased as a result of the second and the third engagement portions engage respectively with the second and the third engaging portions of the liquid supply unit.

Application Example 5

In the above protection member, when the protection member is viewed in a plan view in a direction extending from the first side wall toward the second partition wall in a state where the protection member is attached to the liquid supply unit, at least a part of the first engagement portion may be located within a region formed by extending the opening in a direction extending from the sealing portion toward the supply hole.

In this application example, the distance between the opening and the first engagement portion can be shortened by providing the opening at a position overlapping the first engagement portion compared with the case of providing the opening at a position that does not overlap the first engagement portion. Accordingly, the position accuracy of the opening relative to the terminal portion can be increased.

Application Example 6

In the above protection member, the distance from the sealing portion to the first engagement portion may be longer than the distance from the sealing portion to the opening.

In this application example, the sealing portion of the protection member is a portion that comes into contact with the liquid supply unit, and the first engagement portion of the protection member is a portion that comes into contact with the first engaging portion of the liquid supply unit. The position accuracy of the opening relative to the terminal portion can be further increased by bringing the position of the opening close to a position between these two contacting portions.

Application Example 7

In the above protection member, the first engagement portion, the second engagement portion, and the third engagement portion may be arranged such that at least a part of the terminal portion is located in a region formed by connecting, using straight lines, the first engagement portion, the second engagement portion, and the third engagement portion to one another when the protection member is viewed in a plan view in a direction extending from the supply hole toward the sealing portion in a state where the protection member is attached to the liquid supply unit.

In this application example, when the protection member is viewed in a plan view in the direction extending from the supply hole toward the sealing portion in a state where the protection member is attached to the liquid supply unit, the region formed by connecting, using straight lines, the first engagement portion, the second engagement portion, and the third engagement portion to one another is a region in which the position of the protection member relative to the liquid supply unit is most stable. With an arrangement in which at least a part of the terminal portions is located in this region, a shift in the position of the terminal portion relative to the opening can be suppressed.

Application Example 8

Another application example is a liquid supply unit set. The liquid supply unit set includes a liquid supply unit adapted to supply liquid to a liquid ejection apparatus, a protection member adapted to be attached to the liquid supply unit, and a film material joined to the liquid supply unit and the protection member. The liquid supply unit includes: a liquid containing portion adapted to contain the liquid; a liquid supply portion adapted to supply the liquid in the liquid containing portion to a liquid ejection apparatus; a terminal portion adapted to be electrically connected to an electrical connection portion provided in the liquid ejection apparatus; an engaging portion adapted to engage with the liquid ejection apparatus; and an atmosphere communication hole being in communication with the liquid containing portion. The protection member includes: a sealing portion adapted to seal the liquid supply portion; an engagement portion adapted to engage with the engaging portion; an operation portion for operating to release the engagement portion from the engaging portion; and an opening provided in a portion opposed to the terminal portion such that at least a part of the terminal portion is exposed through the opening in a state where the protection member is attached to the liquid supply unit. The film material is joined to the liquid supply unit to seal the atmosphere communication hole of the liquid supply unit, and is also joined to the operation portion of the protection member.

With the liquid supply unit set in this application example, when the protection member is attached to the liquid supply unit, the terminal portion can be easily protected by the portion opposed to the terminal portion. In addition, with this protection member, when the protection member is attached to the liquid supply unit, at least a part of the terminal portion of the liquid supply unit is exposed via the opening of the protection member. For this reason, the terminal portion of the liquid supply unit can be touched via the opening in a state where the protection member is attached to the liquid supply unit. As a result, for example, an electrical test can be conducted via the terminal portion in a state where the protection member is attached to the liquid supply unit. In addition, in this liquid supply unit set, the film material joined to the liquid supply unit in a state where the atmosphere communication hole that is in communication with the liquid containing portion is sealed is also joined to the operation portion of the protection member. For this reason, movement of the operation portion is restricted by the film material even if the operation portion is operated in a state where the film material is joined thereto, and it is accordingly difficult to remove the protection member from the liquid supply unit. With this configuration, the order in which the film material is removed and thereafter the protection member is removed can be defined.

Application Example 9

In the above liquid supply unit set, when the terminal portion is viewed via the opening in the state where the protection member is attached to the liquid supply unit, at least a part of the engagement portion may be located within a region formed by extending the opening in a direction from the sealing portion toward the engagement portion.

In this application example, the position accuracy of the opening relative to the terminal portion can be easily increased compared with the case where the engagement portion is located out of the region formed by extending the opening in the direction from the sealing portion toward the engagement portion.

Application Example 10

In the above liquid supply unit set, the position at which the film material is joined to the protection member may be the same as the position at which the film material is joined to the liquid supply unit in a direction extending from the sealing portion toward the engagement portion when the terminal portion is viewed via the opening in a state where the protection member is attached to the liquid supply unit.

In this application example, since the position at which the film material is joined to the protection member is the same as the position at which the film material is joined to the liquid supply unit, the film material can be easily joined to the protection member and the liquid supply unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
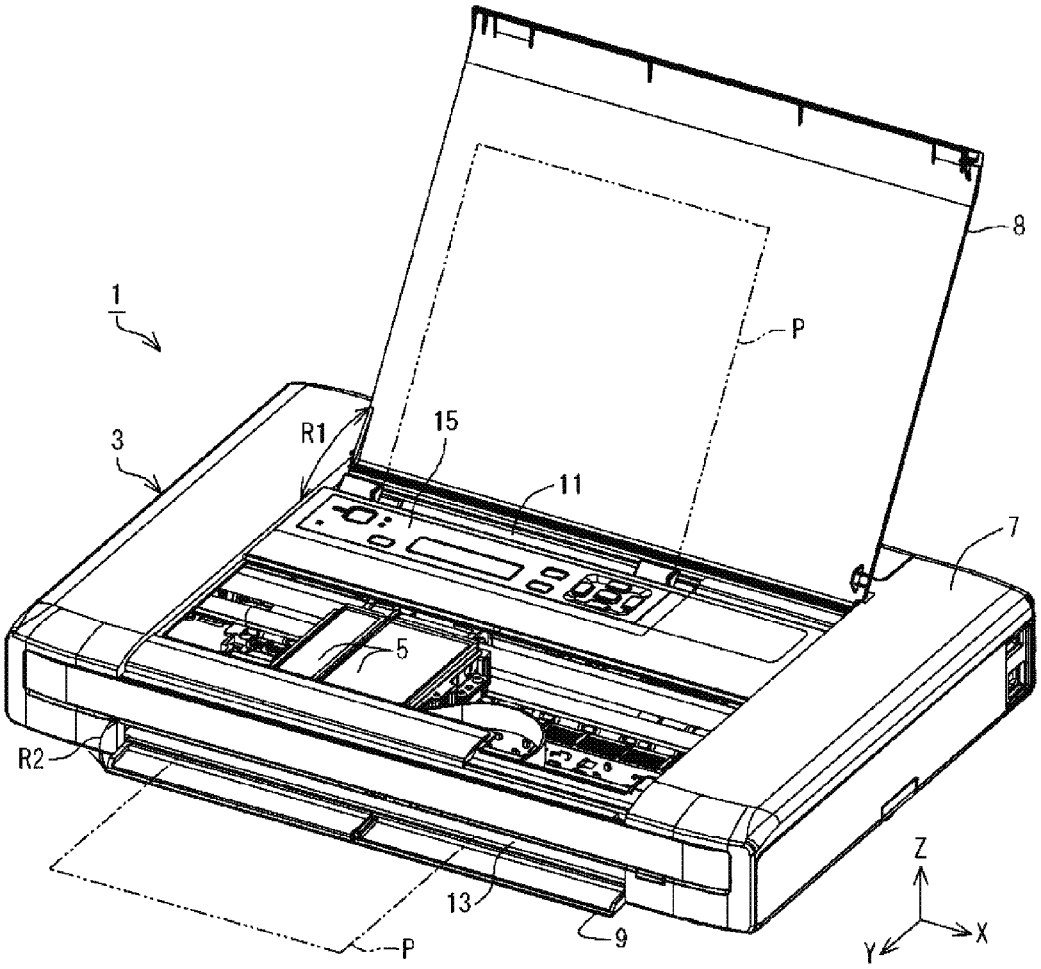
FIG. 1 is a perspective view of a printer according to the present embodiment.

An embodiment will be described with reference to the drawings, taking a liquid ejection system as an example. Note that the scale of configurations and members may be different in the drawings so that each configuration has a recognizable size.

As shown in FIG. 1, a liquid ejection system 1 according to the present embodiment has a printer 3, which is an exemplary liquid ejection apparatus, and cartridges 5, which are exemplary liquid supply units. The cartridges 5 can contain ink, which is exemplary liquid. Note that in FIG. 1, X, Y, and Z axes indicate mutually orthogonal coordinate axes. The X, Y, and Z axes are also shown as necessary in the subsequent diagrams. In the present embodiment, when the printer 3 is in use, the printer 3 is arranged in a horizontal plane defined by the X axis and the Y axis (XY plane). The Z axis is an axis orthogonal to the horizontal plane. When the printer 3 is in use, a Z-axis direction is a vertically upward direction. Also, when the printer 3 is in use, a −Z-axis direction is a vertically downward direction in FIG. 1. Note that, of each of the X, Y, and Z axes, the orientation of the arrow indicates a + (positive) direction, and the orientation opposite to the orientation of the arrow indicates a − (negative) direction.

As shown in FIG. 1, the printer 3 according to the present embodiment has a case 7, a paper feed cover 8, and a paper discharge cover 9. The case 7, the paper feed cover 8, and the paper discharge cover 9 constitute an outer shell of the printer 3. A later-described mechanism unit is housed in the case 7.

The paper feed cover 8 is configured to be able to rotate in direction R1 in FIG. 1 relative to the case 7. The paper feed cover 8 is thereby configured to be able to open and close relative to the case 7. When the paper feed cover 8 is open relative to the case 7 (hereinafter called an open state), a recording medium P, such as recording paper, can be introduced from a paper feed portion 11 to the printer 3. The paper discharge cover 9 is configured to be able to rotate in direction R2 in FIG. 1 relative to the case 7. The paper discharge cover 9 is thereby configured to be able to open and close relative to the case 7. When the paper discharge cover 9 is in an open state relative to the case 7, the recording medium P can be discharged from a paper discharge portion 13 to the outside of the printer 3. Note that FIG. 1 shows the paper feed cover 8 and the paper discharge cover 9 in the open state.

The printer 3 also has an operation panel 15. The operation panel 15 is provided with a power button, other operation buttons, and the like. An operator who operates the printer 3 can operate the printer 3 via the power button and the other operation buttons in a state where the paper feed cover 8 is open relative to the case 7.

Figure 2:
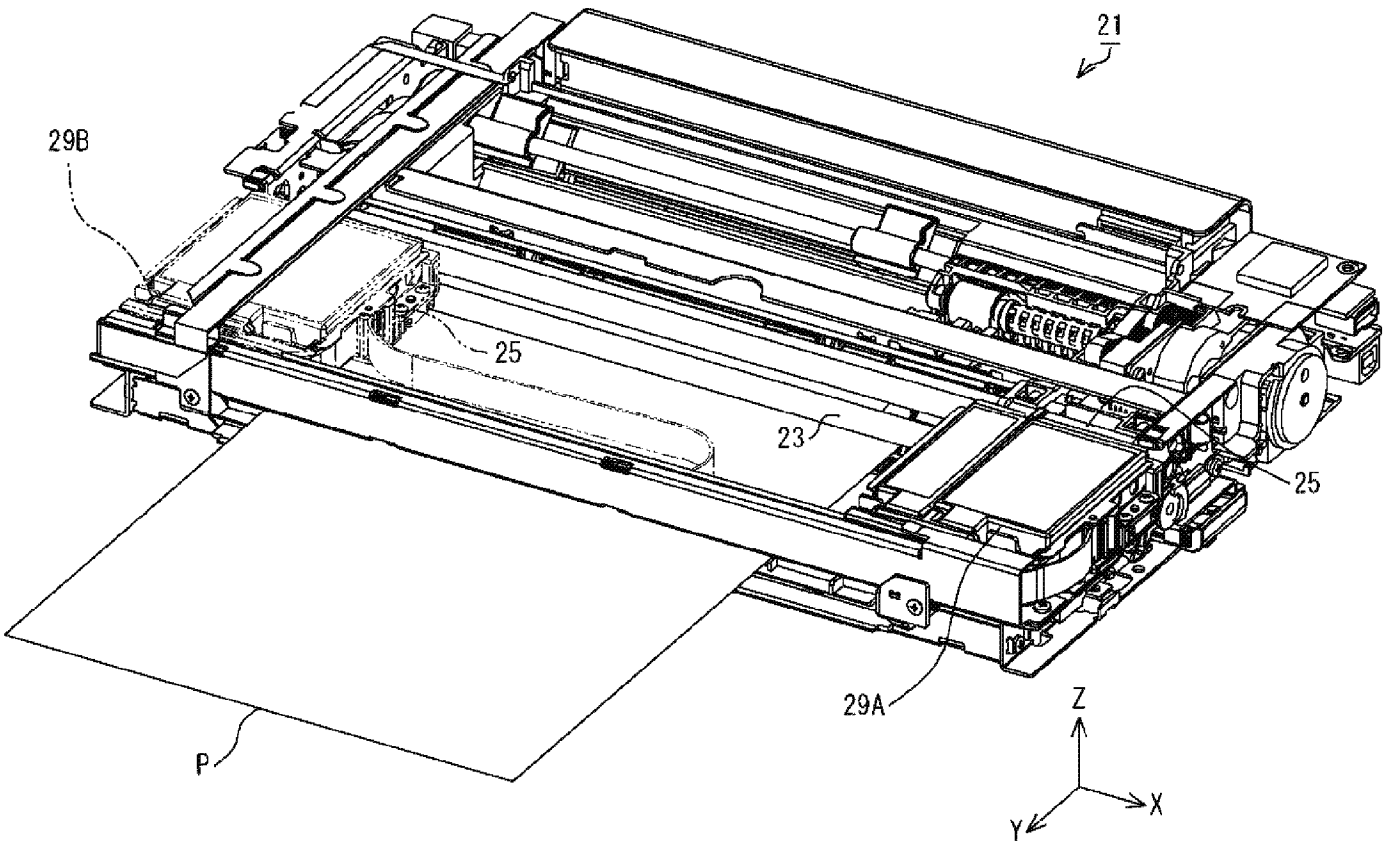
FIG. 2 is a perspective view of a mechanism unit of the printer according to the present embodiment.

As shown in FIG. 2, a mechanism unit 21 has a conveyance roller 23 and a carriage unit 25. The mechanism unit 21 also has a medium conveyance mechanism (not shown) and a carriage conveyance mechanism (not shown). The medium conveyance mechanism conveys the recording medium P along the Y axis using the power of a motor (not shown). The carriage conveyance mechanism conveys the carriage unit 25 along the X axis using the power of a motor (not shown). The carriage unit 25 can be moved back and forth along the X axis between a first waiting position 29A and a second waiting position 29B by the carriage conveyance mechanism. In the present embodiment, the region in which the carriage unit 25 can move is the region between the first waiting position 29A and the second waiting position 29B.

Figure 3:
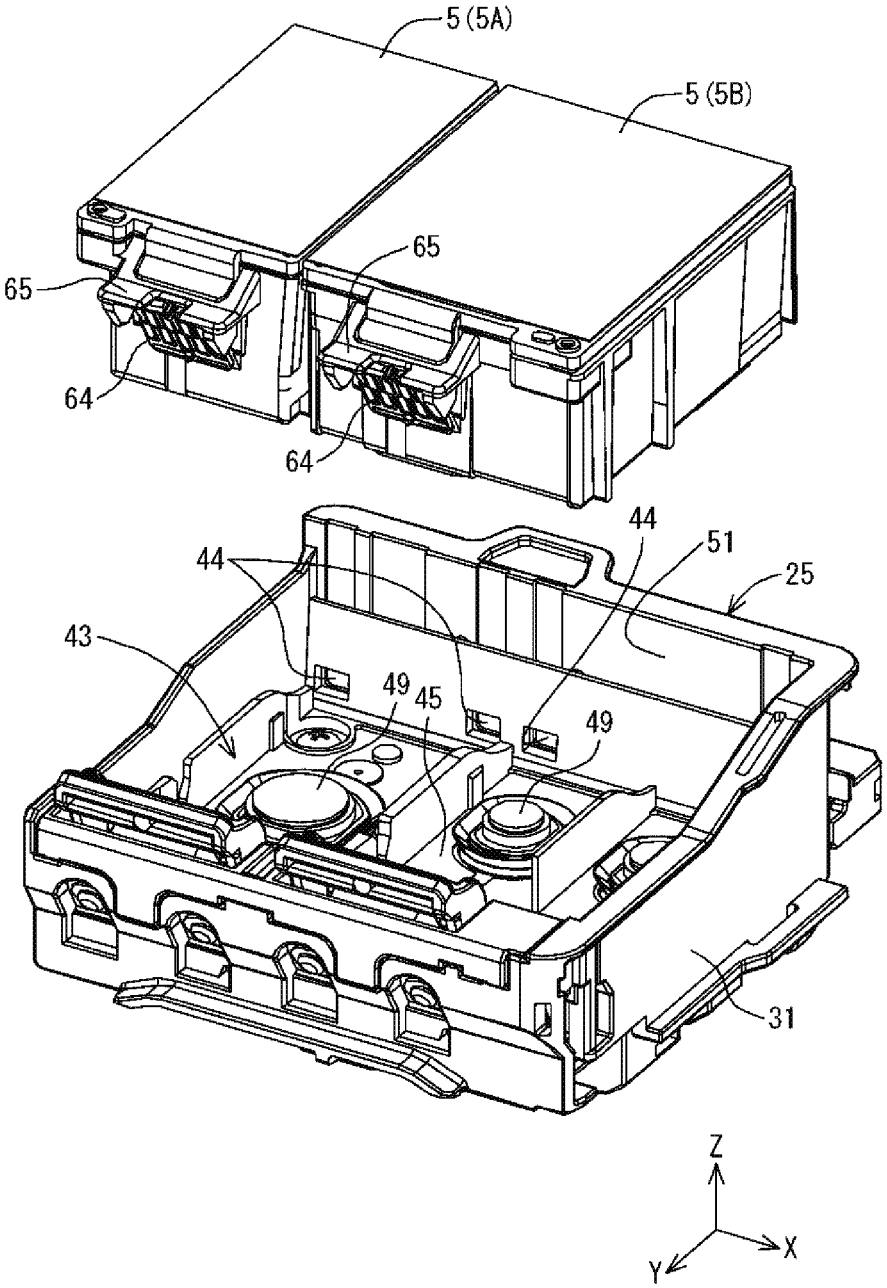
FIG. 3 is a perspective view of a carriage unit and cartridges according to the present embodiment.

As shown in FIG. 3, the carriage unit 25 has a holder 31. The cartridges 5 are installed in the holder 31. A recessed portion 43 is formed in the holder 31. The recessed portion 43 is formed so as to be recessed in the −Z-axis direction. The cartridges 5 are attached to the recessed portion 43 of the holder 31. In the present embodiment, the cartridges 5 are configured to be able to be attached to and detached from the holder 31. Engaging holes 44 are formed in the holder 31. Each cartridge 5 is provided with later-described engaging projection portions (not shown) at an end portion thereof in the −Y-axis direction. Upon the cartridges 5 being attached to the recessed portion 43 of the holder 31, the engaging projection portions of the cartridges 5 engage with the engaging holes 44 of the holder 31.

Ink, which is exemplary liquid, is contained in each cartridge 5. In the present embodiment, a plurality of (two) cartridges 5 can be attached to the holder 31. However, the number of cartridges 5 is not limited to being plural (two), and may be one, or three or greater. In the following description, in the case of individually identifying the two cartridges 5, the two cartridges 5 are referred to as a cartridge 5A and a cartridge 5B.

A plurality of different types of ink are contained in the two cartridges 5. In the present embodiment, a plurality of different colors of ink are contained in the two cartridges 5. As the colors of the ink contained in the two cartridges 5, the present embodiment employs four colors, namely black, yellow, magenta, and cyan. Among the four colors of ink, the black ink is contained in the cartridge 5A. Among the four colors of ink, the yellow, magenta, and cyan inks are contained in the cartridge 5B.

Figure 4:
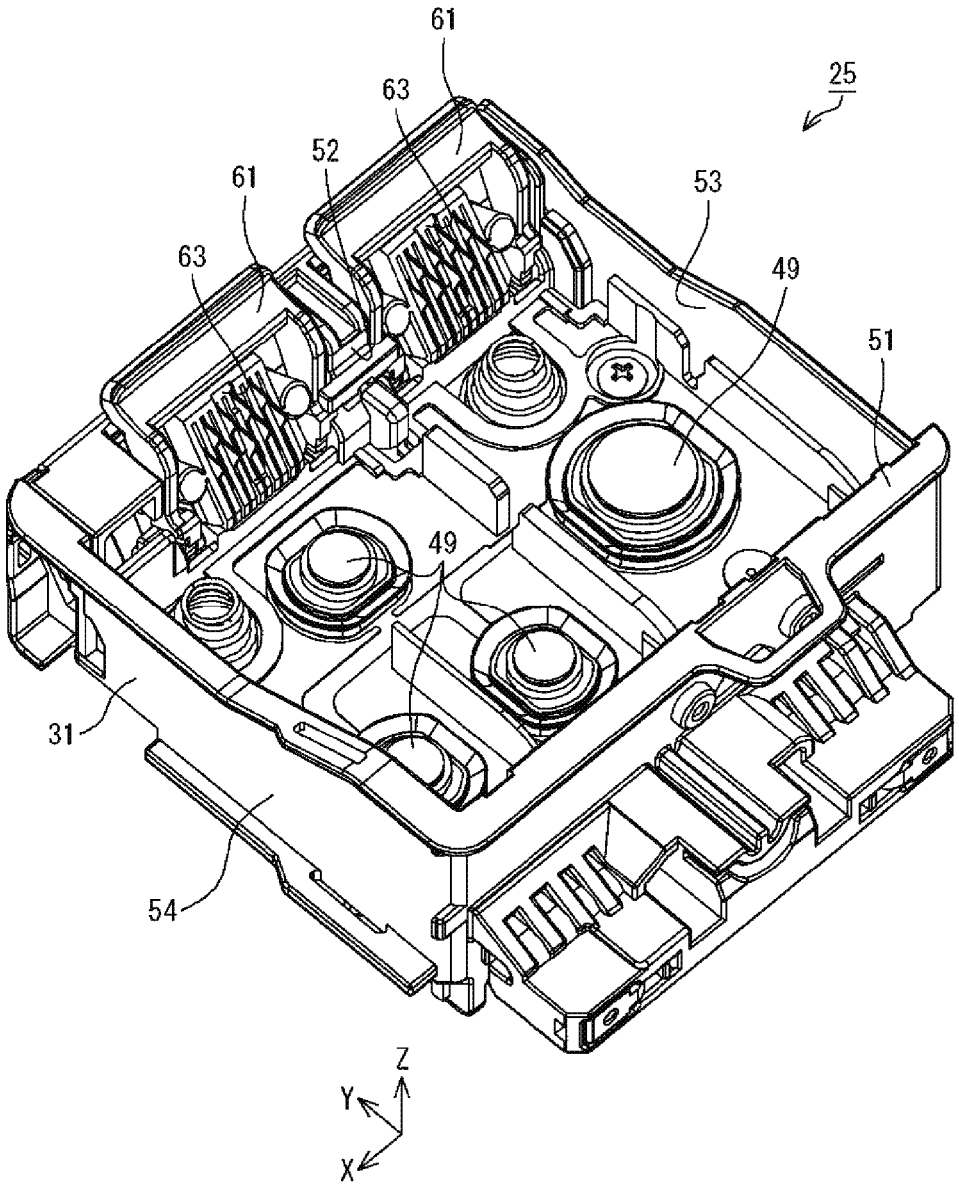
FIG. 4 is a perspective view of the carriage unit according to the present embodiment.

Four introduction portions 49 are provided on a bottom portion 45 of the recessed portion 43. As shown in FIG. 4, the holder 31 has a side wall 52 on the side opposite (in the Y-axis direction) to a side wall 51 with the four introduction portions 49 therebetween along the Y axis. A side wall 53 and a side wall 54 are provided at positions facing along the X axis with the four introduction portions 49 therebetween. The side wall 53 is located on the side in the −X-axis direction relative to the four introduction portions 49. The side wall 54 is located on the side in the X-axis direction relative to the four introduction portions 49. The side wall 51, the side wall 52, the side wall 53, and the side wall 54 project in the Z-axis direction from the bottom portion 45. Note that the side wall 51 to the side wall 54 do not need to be orthogonal to the bottom portion 45, and need only intersect the bottom portion 45. The bottom portion 45 is surrounded by the side wall 51, the side wall 52, the side wall 53, and the side wall 54. The recessed portion 43 is thereby demarcated.

The side wall 52 is provided with two engagement levers 61 and two contact point mechanisms 63. The two engagement levers 61 are arranged side-by-side along the X axis. The two contact point mechanisms 63 are arranged side-by-side along the X axis. Note that the contact point mechanisms 63 are exemplary electrical connection portions. Here, as shown in FIG. 3, the two cartridges 5 are each provided with a circuit board 64 and an engaging portion 65. In each cartridge 5, the engaging portion 65 is provided at an end portion thereof in the Y-axis direction. Note that the engaging holes 44 are formed in the side wall 51 of the holder 31.

The circuit board 64 is provided with a storage device (not shown), such as a nonvolatile memory. Each contact point mechanism 63 shown in FIG. 4 is configured to be able to be electrically connected to the storage device provided on the circuit board 64 of the corresponding cartridge 5. The engagement levers 61 shown in FIG. 4 are configured to be able to engage with the engaging portion of the cartridges 5. Upon the cartridges 5 being attached to the holder 31, the engaging portions 65 of the cartridges 5 engage with the engagement levers 61 of the holder 31. In a state where the cartridges 5 are attached to the holder 31, the storage devices provided on the circuit boards 64 of the cartridges 5 are electrically connected to a control circuit (not shown) of the printer 3 via the contact point mechanisms 63. Thereby, various kinds of information is exchanged between the storage devices provided on the circuit boards 64 of the cartridges 5 and the control circuits of the printer 3.

Figure 5:
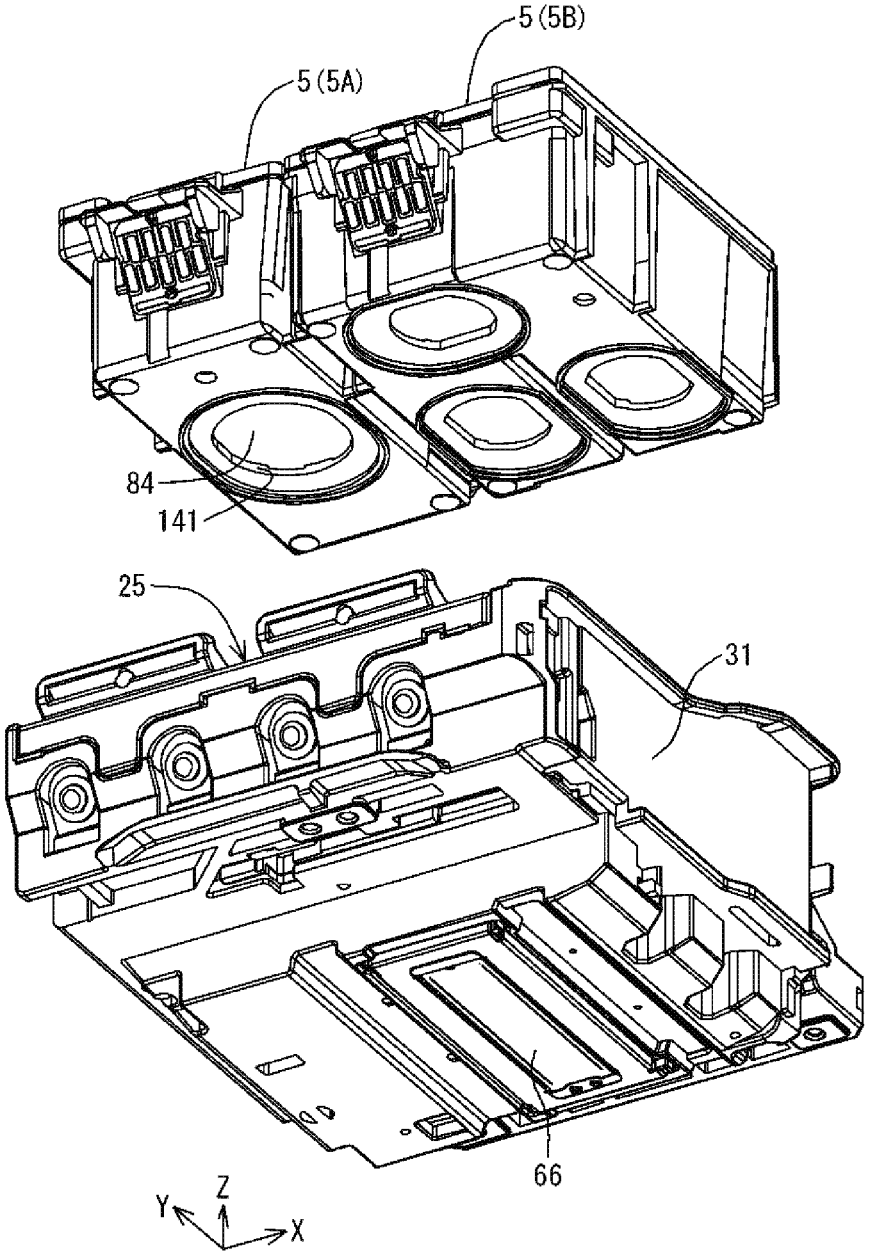
FIG. 5 is a perspective view of the carriage unit and the cartridges according to the present embodiment.

As shown in FIG. 5, the carriage unit 25 has a print head 66. In the carriage unit 25, the print head 66 is provided in the −Z-axis direction relative to the holder 31. Ink is supplied to the print head 66 from the two cartridges 5 via the introduction portions 49 (FIG. 3). The print head 66 discharges the ink supplied from the two cartridges 5 as ink droplets from nozzles (not shown). As mentioned above, the print head 66 is installed in the carriage unit 25. Therefore, the print head 66 can be conveyed along the X axis via the carriage unit 25 by the carriage conveyance mechanism. The recording medium P is printed onto by discharging the ink droplets from the print head 66 while changing the relative position of the print head 66 with respect to the recording medium P using the medium conveyance mechanism and the carriage conveyance mechanism.

Note that in the printer 3, the X-axis direction and the −X-axis direction are defined as directions in which the print head 66 is conveyed via the carriage unit 25, and the Y-axis direction is defined as a direction in which the recording medium P is conveyed. The Z-axis direction is a direction orthogonal to both the X-axis direction and the Y-axis direction. When the printer 3 is in use, the X-axis direction and the Y-axis direction are horizontal directions, and the Z-axis direction is a vertically upward direction. However, in the following description, the Z-axis direction is described as a direction different from (intersecting) the vertical direction in some cases.

Figure 6:
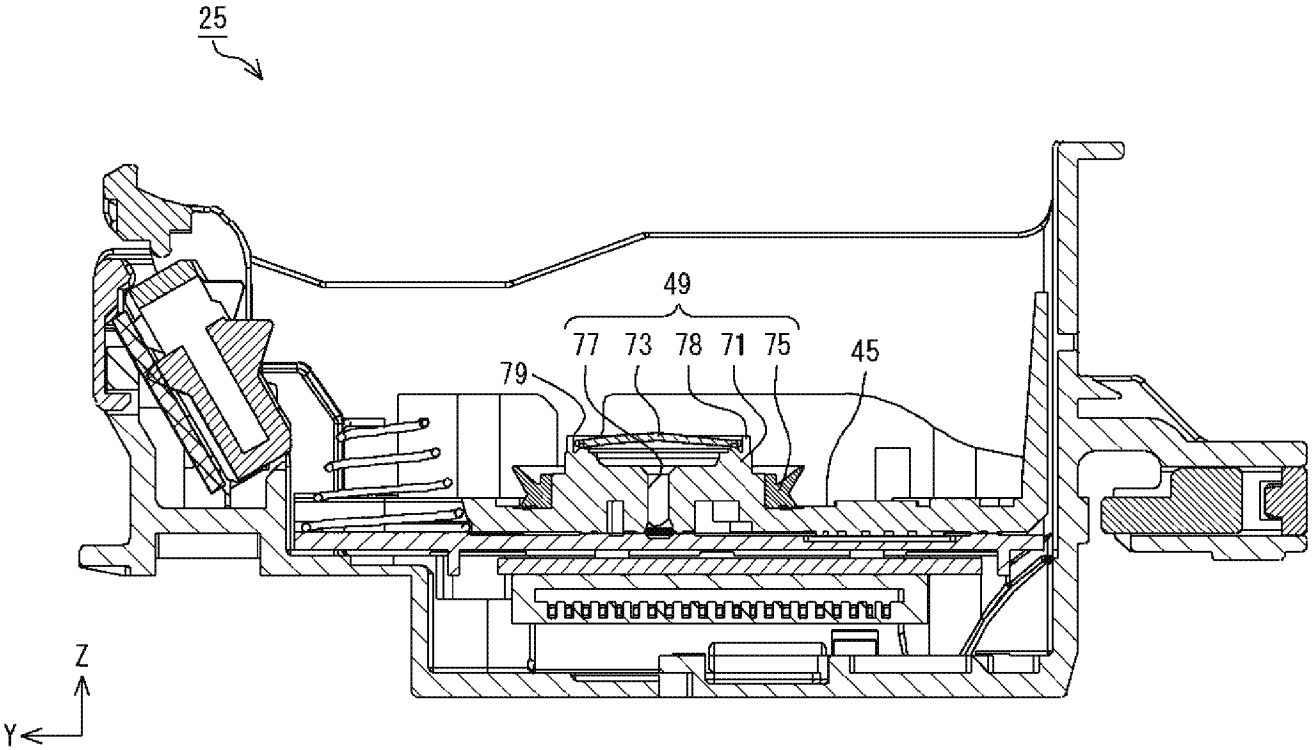
FIG. 6 is a cross-sectional view of the carriage unit according to the present embodiment.

As shown in FIG. 6, which is a cross-sectional view of the carriage unit 25, the introduction portions 49 are provided on the bottom portion 45 of the holder 31. Note that FIG. 6 shows a cross-section of the carriage unit 25 taken along a YZ plane that passes through one of the introduction portions 49. Each introduction portion 49 includes an introduction tube 71, a filter 73, and packing 75. The introduction tube 71 is provided on the bottom portion 45, and projects so as to protrude in the Z-axis direction from the bottom portion 45. A flow path 77 and a bank portion 78 are formed in the introduction tube 71. The flow path 77 is a passage for the ink supplied from the corresponding cartridge 5, and is provided as an opening that passes through the bottom portion 45. The bank portion 78 is provided at an end portion of the introduction tube 71 in the Z-axis direction, and projects so as to protrude in the Z-axis direction. When the bottom portion 45 is viewed in a plan view, the bank portion 78 surrounds the flow path 77 in a ring-like manner within the recessed portion 43. For this reason, the bank portion 78 forms a tubular shape. An opening 79 of the tubular bank portion 78 is a port through which the introduction portion 49 receives the ink from the cartridge 5.

In the present embodiment, the Z-axis direction is a direction in which the tubular bank portion 78 projects, i.e., a direction in which the flow path 77 extends. That is to say, the center axis of the flow path 77 extends along the Z axis. The filter 73 is provided within the bank portion 78, and covers the opening of the flow path 77 on the side of the recessed portion 43, from the side of the recessed portion 43. The packing 75 is provided on the bottom portion 45 and surrounds the bank portion 78 within the recessed portion 43. The packing 75 is made of an elastic material, such as rubber or elastomer, for example.

Figure 7:
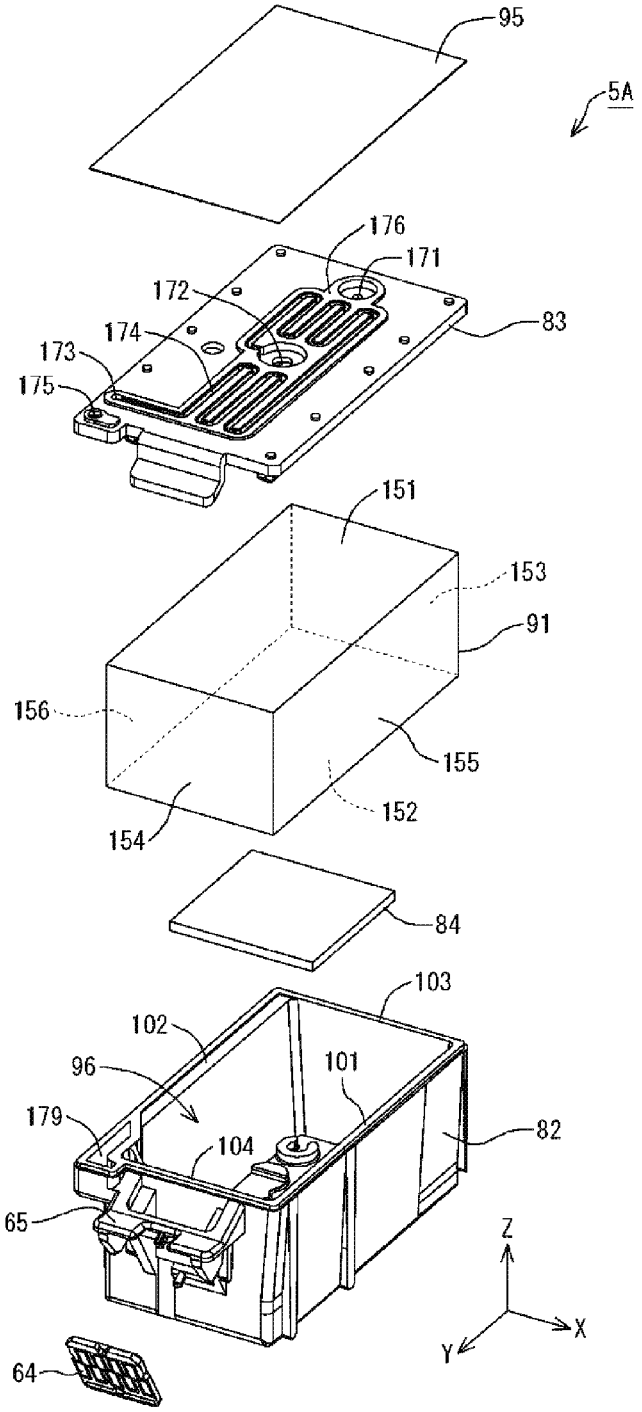
FIG. 7 is an exploded perspective view of a cartridge according to the present embodiment.

The cartridge 5A and the cartridge 5B will now be described. As shown in FIG. 7, the cartridge 5A has a first case 82, which is an exemplary housing, and a second case 83, which is an exemplary lid. The first case 82 and the second case 83 constitute an outer shell of the cartridge 5A. The cartridge 5A also has a holding member 84, a holding member 91, and a sheet member 95. The first case 82 has a container-like shape, and has a recessed portion 96. The holding member 84 and the holding member 91 are housed in the recessed portion 96 of the first case 82.

Figure 8:
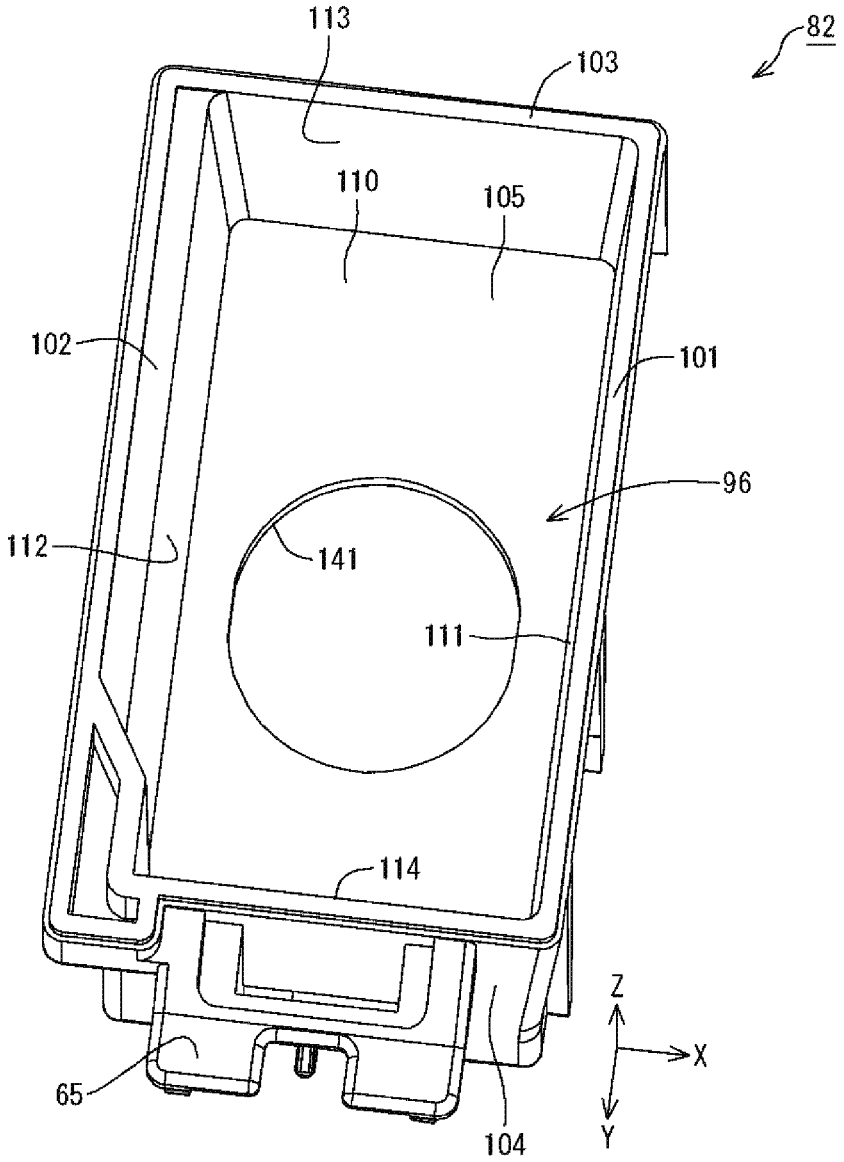
FIG. 8 is a perspective view of a first case according to the present embodiment.

As shown in FIG. 8, the first case 82 has a partition wall 101, a partition wall 102, a partition wall 103, a partition wall 104, and a partition wall 105. The partition wall 105 spreads along an XY plane. The partition wall 101 to the partition wall 104 project in the Z-axis direction from the partition wall 105. Note that the partition wall 101 to the partition wall 104 do not need to be orthogonal to the partition wall 105, and need only intersect the partition wall 105. When the partition wall 105 is viewed in a plan view in the −Z-axis direction, the partition wall 101 to the partition wall 104 surround the partition wall 105. When the partition wall 105 is viewed in a plan view in the −Z-axis direction, the partition wall 101 and the partition wall 102 extend along the Y axis. When the partition wall 105 is viewed in a plan view in the −Z-axis direction, the partition wall 103 and the partition wall 104 extend along the X axis.

The partition wall 101 and the partition wall 102 are opposed to each other along the X axis with the partition wall 105 therebetween. The partition wall 101 is located in the X-axis direction relative to the partition wall 102. The partition wall 103 and the partition wall 104 are opposed to each other along the Y axis with the partition wall 105 therebetween. The partition wall 104 is located in the Y-axis direction relative to the partition wall 103. The partition wall 103 intersects the partition wall 101 and the partition wall 102. The partition wall 104 also intersects the partition wall 101 and the partition wall 102. With the above configuration, the recessed portion 96 is formed in the first case 82. Note that the aforementioned engaging portion 65 is provided on the partition wall 104. The engaging portion 65 projects in the Y-axis direction from the partition wall 104. As shown in FIG. 7, the engaging portion 65 is located in the −Z-axis direction relative to an end portion of the partition wall 104 in the Z-axis direction.

In the first case 82 shown in FIG. 8, the recessed portion 96 is demarcated by a bottom wall 110, a first side wall 111, a second side wall 112, a third side wall 113, and a fourth side wall 114. The first side wall 111 to the fourth side wall 114 constitute inner walls of the recessed portion 96, and project in the Z-axis direction from the bottom wall 110. Note that the first side wall 111 to the fourth side wall 114 do not need to be orthogonal to the bottom wall 110, and need only intersect the bottom wall 110. When the bottom wall 110 is viewed in a plan view in the −Z-axis direction, the first side wall 111 to the fourth side wall 114 surround the bottom wall 110. The recessed portion 96 is thereby demarcated. When the bottom wall 110 is viewed in a plan view, the first side wall 111 and the second side wall 112 extend along the Y axis. Similarly, the third side wall 113 and the fourth side wall 114 extend along the X axis.

The bottom wall 110 is a part of the partition wall 105, and is a wall face within the recessed portion 96. The first side wall 111 is a part of the partition wall 101, and is a wall face within the recessed portion 96. The second side wall 112 is a part of the partition wall 102, and is a wall face within the recessed portion 96. The third side wall 113 is a part of the partition wall 103, and is a wall face within the recessed portion 96. The fourth side wall 114 is a part of the partition wall 104, and is a wall face within the recessed portion 96. Note that the bottom wall 110 and the first side wall 111 to the fourth side wall 114 are not limited to being flat faces, and may be uneven or curved, for example. Outer faces of the partition wall 101 to the partition wall 105 relative to the recessed portion 96 are not limited to being flat faces either, and may be uneven or curved, for example.

A supply hole 141 is formed in the partition wall 105. The supply hole 141 penetrates the partition wall 105. The supply hole 141 formed in the recessed portion 96 passes through the inside of the recessed portion 96 to the outside of the first case 82. Ink contained in the recessed portion 96 is discharged to the outside of the cartridge 5A from the supply hole 141.

Figure 9:
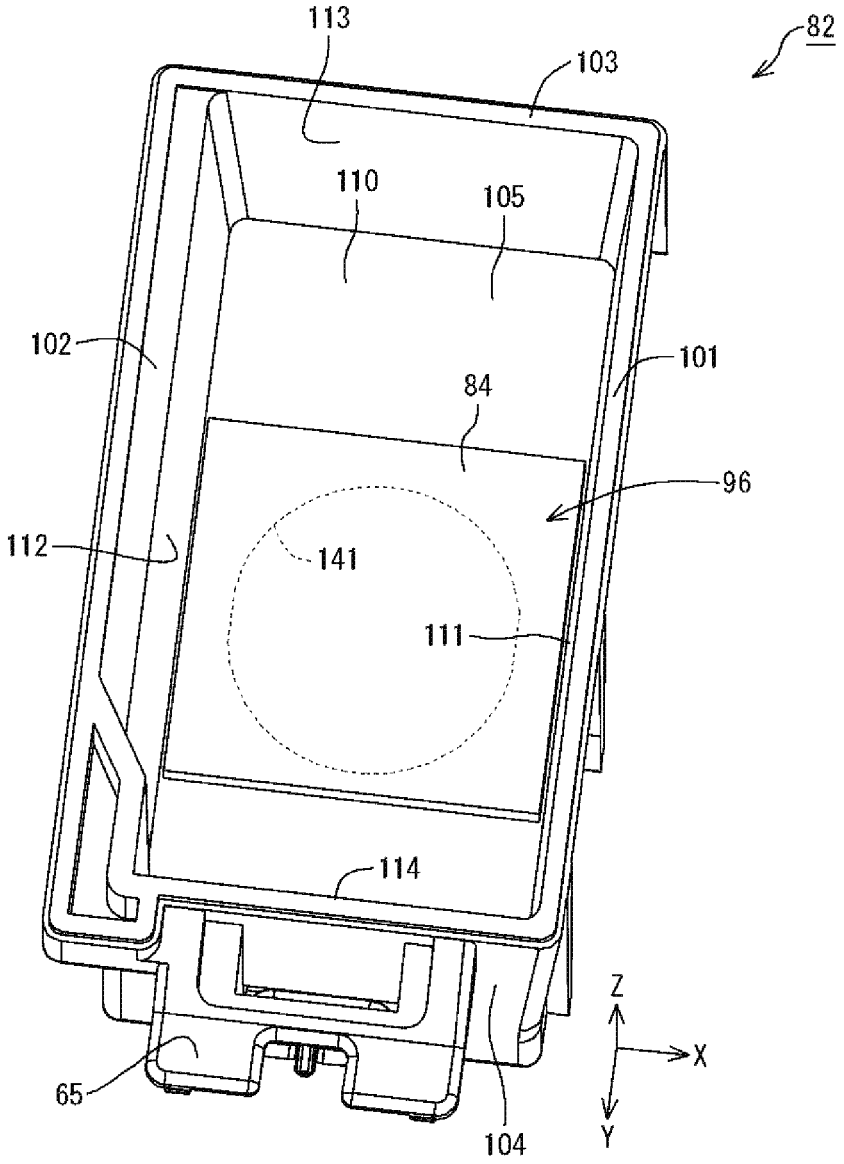
FIG. 9 is a perspective view of the first case and a holding member according to the present embodiment.

As shown in FIG. 9, the holding member 84 is housed in the recessed portion 96 of the first case 82. The holding member 84 has a plate shape and a size that allows the holding member 84 to cover the supply hole 141. The holding member 84 is provided at a position overlapping the supply hole 141, and covers the supply hole 141 from the inside of the recessed portion 96. The holding member 84 is placed on the bottom wall 110 of the recessed portion 96. The holding member 84 has the properties of absorbing ink and holding the absorbed ink. Various materials such as foam, felt, and nonwoven fabric may be employed as materials for the holding member 84, for example. In the present embodiment, nonwoven fabric is employed as the material for the holding member 84.

As shown in FIG. 7, the holding member 91 is provided on the side of the second case 83 relative to the holding member 84. That is to say, the holding member 91 is present between the holding member 84 and the second case 83. In the recessed portion 96, the holding member 91 and the holding member 84 are in contact with each other. Note that the recessed portion 96 is configured to be further narrowed in the −Z-axis direction from the side of the second case 83. The holding member 91 is formed to be larger than the recessed portion 96. For this reason, upon the holding member 91 being housed in the recessed portion 96, the holding member 91 is compressed as the holding member 91 moves toward the partition wall 105 (FIG. 9). As a result, in the recessed portion 96, the capillary force of the holding member 91 increases from the side of the second case 83 toward the side of the partition wall 105.

A fibrous member formed by bundling synthetic resin that is processed into a fibrous state, a foamable resin member such as polyurethane, and the like may be employed as materials for the holding member 91, for example. In the present embodiment, a fibrous member formed by bundling synthetic resin processed into a fibrous state is employed as the material for the holding member 91. Furthermore, synthetic resin including polypropylene, which is included in the material of the first case 82, is favorable as the synthetic resin that constitutes the fibrous member.

Here, in the holding member 91, a face opposed to the second case 83 is defined as a first face 151, as shown in FIG. 7. A face opposed to the first face 151 is defined as a second face 152. A face intersecting the first face 151 and the second face 152 is defined as a third face 153. A face intersecting the first face 151 and the second face 152 and opposed to the third face 153 is defined as a fourth face 154. A face intersecting the first face 151, the second face 152, the third face 153, and the fourth face 154 is defined as a fifth face 155. A face intersecting the first face 151, the second face 152, the third face 153, and the fourth face 154 and opposed to the fifth face 155 is defined as a sixth face 156. Note that the first face 151 to the sixth face 156 are not limited to being flat faces, and may be uneven or curved, for example.

In the holding member 91, the second face 152 is opposed to the bottom wall 110 (FIG. 8), the third face 153 is opposed to the third side wall 113, the fourth face 154 is opposed to the fourth side wall 114, the fifth face 155 is opposed to the first side wall 111, and the sixth face 156 is opposed to the second side wall 112.

Figure 10:
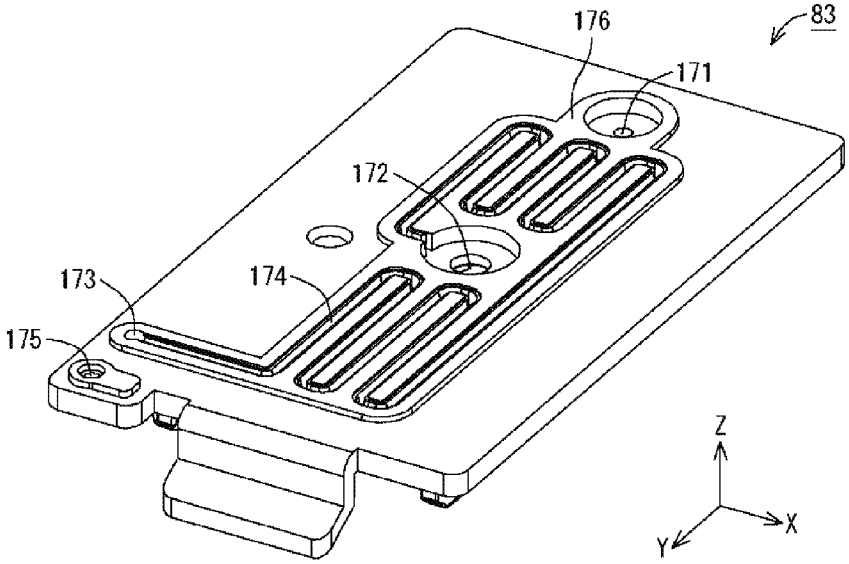
FIG. 10 is a perspective view of a second case according to the present embodiment.

As shown in FIG. 10, the second case 83 has a plate-like appearance. In the second case 83, an injection hole 171, a communication hole 172, a relay hole 173, an introduction groove 174, an introduction hole 175, which is an exemplary atmosphere communication hole, and a bank portion 176 are formed. The injection hole 171, the communication hole 172, the relay hole 173, and the introduction hole 175 penetrate the second case 83 along the Z axis. The bank portion 176 is formed in the second case 83 on the side in the Z-axis direction, and projects in the Z-axis direction from the second case 83.

The injection hole 171, the communication hole 172, the relay hole 173, and the introduction groove 174 are surrounded by the bank portion 176. The injection hole 171 is independently surrounded by the bank portion 176. The communication hole 172, the introduction groove 174, and the relay hole 173 are collectively surrounded by the bank portion 176.

When the cartridge 5A is viewed in a plan view in the −Z-axis direction, the injection hole 171 and the communication hole 172 are each formed within a region overlapping the recessed portion 96 (FIG. 7) of the first case 82. The injection hole 171 is used as an injection port when injecting ink into the cartridge 5A. The black ink is injected into the recessed portion 96 from the injection hole 171. After the ink is injected into the cartridge 5A, the injection hole 171 is closed by the sheet member 95 (FIG. 7).

Figure 11:
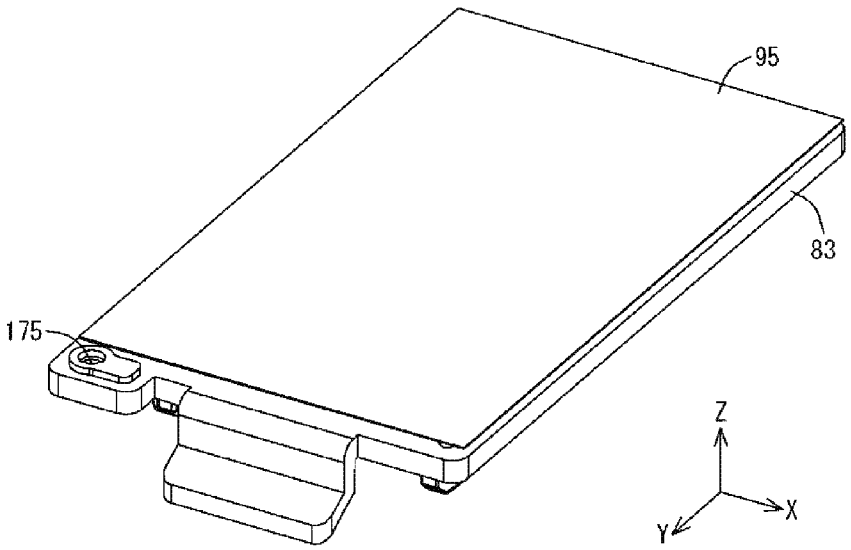
FIG. 11 is a perspective view of the second case and a sheet member according to the present embodiment.

As shown in FIG. 11, the sheet member 95 is joined to the second case 83 from the side in the Z-axis direction relative to the second case 83. At this time, the sheet member 95 is joined to the bank portion 176 (FIG. 10) of the second case 83. The sheet member 95 has a size that allows the sheet member 95 to cover the injection hole 171 (FIG. 10), the communication hole 172, the relay hole 173, and the introduction groove 174. For this reason, the injection hole 171, the communication hole 172, the relay hole 173, and the introduction groove 174 are closed by the sheet member 95 from the side in the Z-axis direction relative to the second case 83. At this time, the introduction hole 175 is located outside of the sheet member 95 and is not closed by the sheet member 95.

Here, the introduction hole 175 and the relay hole 173 are formed at positions overlapping a recessed portion 179 (FIG. 7) of the first case 82. Upon the first case 82 and the second case 83 being joined to each other, the introduction hole 175 and the relay hole 173 are covered with the recessed portion 179 from the side in the −Z-axis direction. The introduction hole 175 and the relay hole 173 are thereby brought into communication with each other via the recessed portion 179 of the first case 82. Thereby, a flow path is configured that stretches from the introduction hole 175, passes through the recessed portion 179, the relay hole 173, and the introduction groove 174 in this order, and leads from the communication hole 172 into the recessed portion 96. Since the introduction hole 175 is open to the atmosphere, the inside of the recessed portion 96 is in communication with the atmosphere via the communication hole 172, the introduction groove 174, the relay hole 173, the recessed portion 179, and the introduction hole 175.

Figure 12:
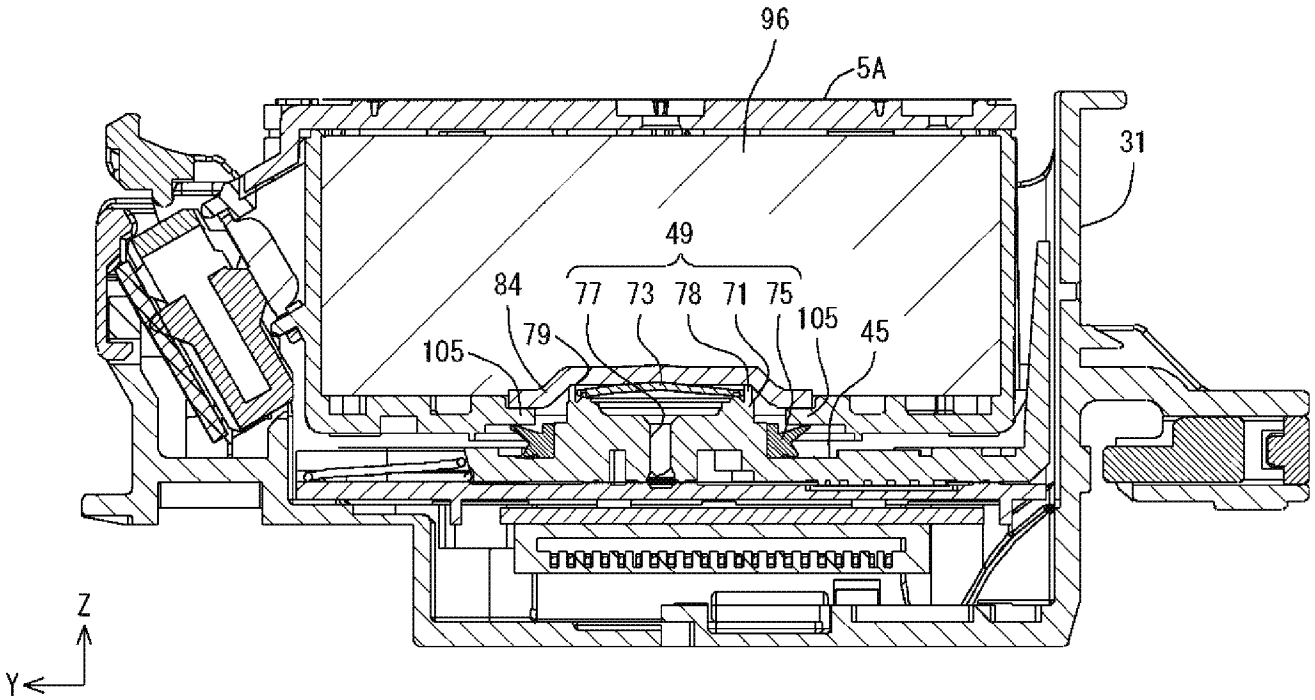
FIG. 12 is a cross-sectional view of the cartridge and the carriage unit according to the present embodiment.

As shown in FIG. 12, upon the cartridge 5A being attached to the holder 31, the packing 75 comes into contact with the partition wall 105 of the cartridge 5A. At this time, the packing 75 comes into contact with the partition wall 105 in a bent state. The packing 75 comes into contact with the partition wall 105 in a state of surrounding the periphery of the supply hole 141 from the outside of the supply hole 141. Thereby, when the ink is supplied from the cartridge 5A to the flow path 77, ink spilling outside the region surrounded by the bank portion 78 is dammed up by the packing 75. With this configuration, it is easy to avoid the leakage of ink in the cartridge 5A into the holder 31 in a state where the cartridge 5A is attached to the holder 31. Upon the cartridge 5A being attached to the holder 31, the bank portion 78 comes into contact with the holding member 84. In a setting according to the present embodiment, upon the cartridge 5A being attached to the holder 31, the bank portion 78 presses the holding member 84 into the recessed portion 96 of the cartridge 5A. With this setting, the state of contact between the holding member 84 and the filter 73 can be easily maintained.

Here, a region of the holding member 84 that is exposed to the outside of the cartridge 5A via the supply hole 141 (FIG. 5) is defined as an ink supply port. A region of the ink supply port in which the opening 79 of the introduction tube 71 (FIG. 12) overlaps the holding member 84 is defined as an ink supply portion. The ink supply portion is an exemplary liquid supply portion. The ink in the cartridge 5A is supplied to the flow path 77 (FIG. 12) of the holder 31 via the ink supply portion. The ink supply portion is a structure including a portion in contact with the introduction tube 71 (FIG. 12), and is a generic name of a structure with which the ink can be supplied from the cartridge 5A to the print head 66. For this reason, the ink supply portion is also defined as a structure including a portion in contact with the introduction tube 71 inserted in the supply hole 141 (FIG. 5). In addition, the ink supply portion is also defined as a structure including a portion in contact with the introduction tube 71 (FIG. 12) in the region of the holding member 84 that is exposed to the outside of the cartridge 5A via the supply hole 141 (FIG. 5). Note that these definitions also apply to the cartridge 5B.

Figure 13:
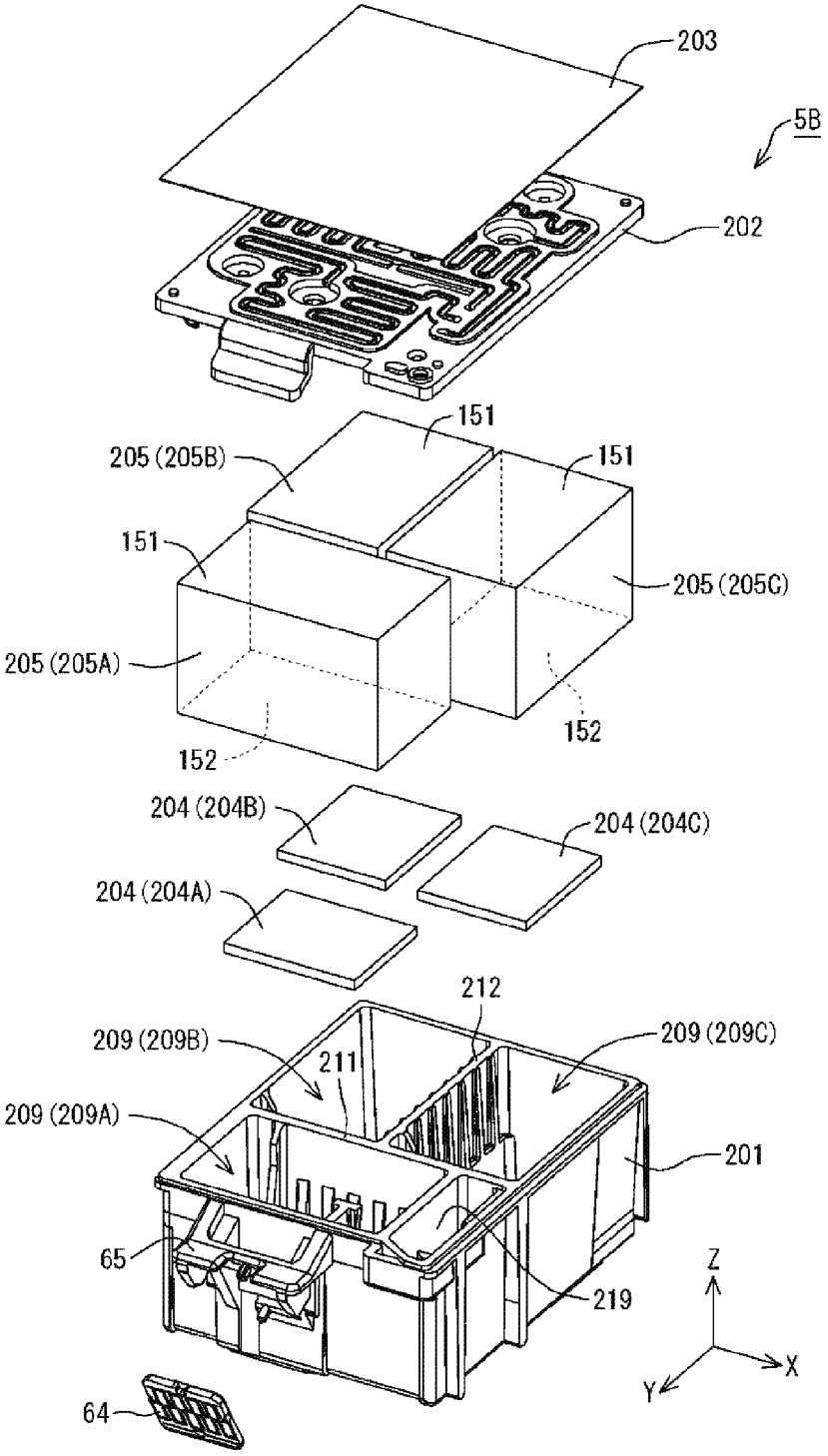
FIG. 13 is an exploded perspective view of the cartridge according to the present embodiment.

As shown in FIG. 13, the cartridge 5B has a third case 201, a fourth case 202, a sheet member 203, three holding members 204, three holding members 205, and a circuit board 64. The third case 201 has a container-like appearance, and has three recessed portions 209. Hereinafter, in the case of identifying each of the three holding members 205, the three holding members 205 are referred to individually as a holding member 205A, a holding member 205B, and a holding member 205C. Also, in the case of identifying each of the three recessed portions 209, the three recessed portions 209 are referred to individually as a recessed portion 209A, a recessed portion 209B, and a recessed portion 209C.

The three recessed portions 209 are partitioned by a partition wall 211 and a partition wall 212. The partition wall 211 extends along the X axis. The partition wall 212 extends along the Y axis. The recessed portion 209A and the recessed portion 209B are adjacent to each other along the Y axis with the partition wall 211 therebetween. Similarly, the recessed portion 209A and the recessed portion 209C are adjacent to each other along the Y axis with the partition wall 211 therebetween. The recessed portion 209A is located in the Y-axis direction relative to the recessed portion 209B and the recessed portion 209C. The recessed portion 209B and the recessed portion 209C are adjacent to each other along the X axis with the partition wall 212 therebetween. The recessed portion 209C is located in the X-axis direction relative to the recessed portion 209B. The three recessed portions 209 are formed having the same dimensions (size). In addition, the three holding members 205 are made of the same material and are formed having the same size. Note that the dimensions or sizes of the recessed portions 209 and the holding members 205 do not need to completely coincide with one another, and may contain some error. The holding members 205 are constituted by a fibrous member as is the holding member 91.

Figure 14:
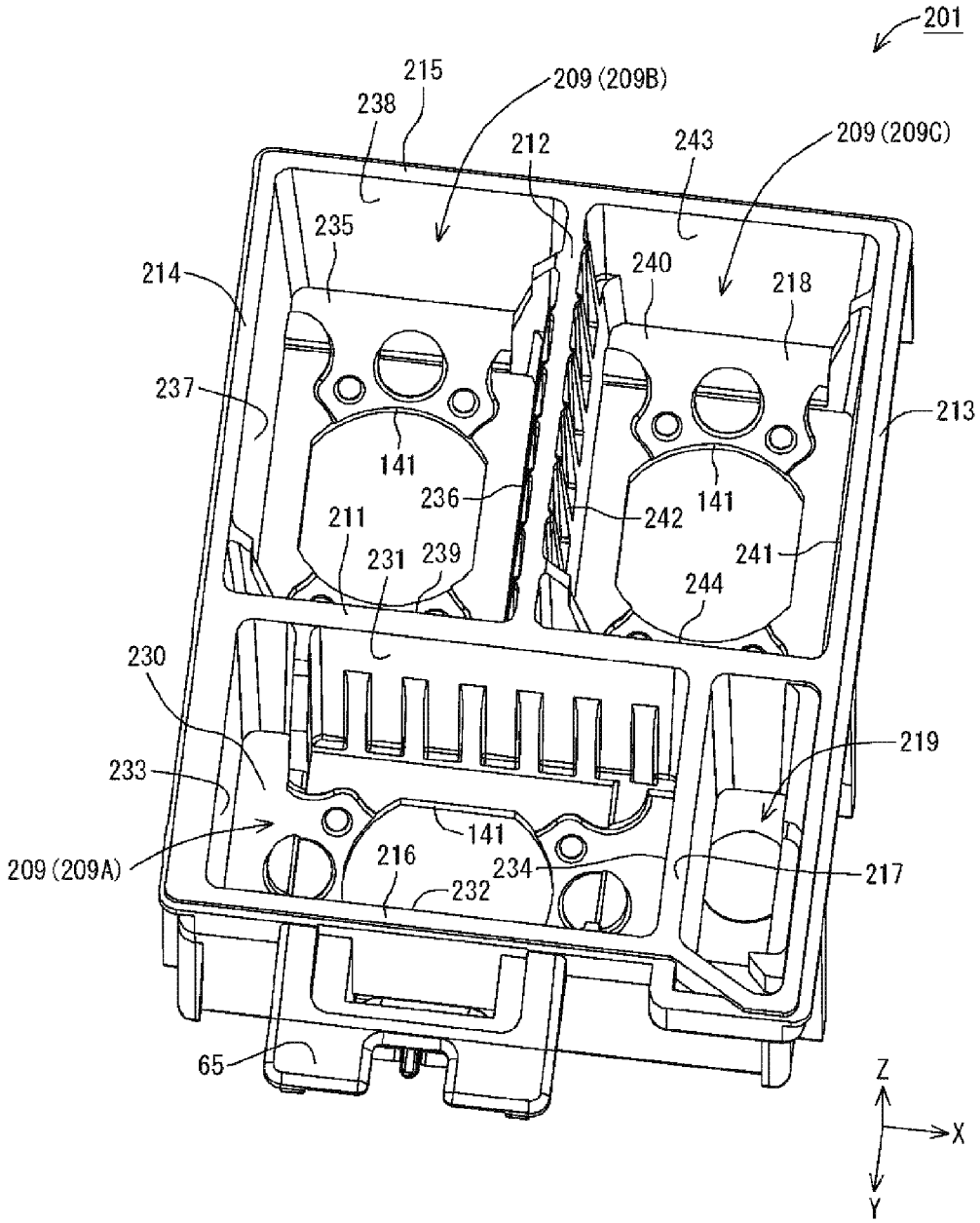
FIG. 14 is a perspective view of a third case according to the present embodiment.

As shown in FIG. 14, the third case 201 has a partition wall 213, a partition wall 214, a partition wall 215, a partition wall 216, a partition wall 217, and a partition wall 218. The partition wall 218 spreads along an XY plane. The partition wall 211 to the partition wall 217 project in the Z-axis direction from the partition wall 218. Note that the partition wall 211 to the partition wall 217 do not need to be orthogonal to the partition wall 218, and need only intersect the partition wall 218. When the partition wall 218 is viewed in a plan view in the −Z-axis direction, the partition wall 213, the partition wall 214, and the partition wall 217 extend along the Y axis. The partition wall 215 and the partition wall 216 extend along the X axis. The partition wall 213 and the partition wall 214 are opposed to each other along the X axis with the partition wall 211 and the partition wall 212 therebetween. The partition wall 213 is located in the X-axis direction relative to the partition wall 214. The partition wall 217 and the partition wall 214 are opposed to each other along the X axis. The partition wall 217 is located in the X-axis direction relative to the partition wall 214. The partition wall 213 and the partition wall 217 are opposed to each other along the X axis. The partition wall 213 is located in the X-axis direction relative to the partition wall 217. Note that a plurality of supply holes 141 are formed in the partition wall 218. The supply holes 141 are formed in the respective recessed portions 209. The supply holes 141 penetrate the partition wall 218.

The partition wall 215 and the partition wall 216 are opposed to each other along the Y axis with the partition wall 211, the partition wall 212, and the partition wall 217 therebetween. The partition wall 216 is located in the Y-axis direction relative to the partition wall 215. The partition wall 213 intersects the partition wall 211, the partition wall 215, and the partition wall 216. The partition wall 214 intersects the partition wall 211, the partition wall 215, and the partition wall 216. The partition wall 215 intersects the partition wall 212, the partition wall 213, and the partition wall 214. The partition wall 217 intersects the partition wall 211 and the partition wall 216. With the above configuration, the three recessed portions 209 are formed in the third case 201.

Note that a recessed portion 219 is formed on the side in the X-axis direction relative to the recessed portion 209A. The recessed portion 219 is located on the side in the X-axis direction relative to the recessed portion 209A with the partition wall 217 therebetween. The recessed portion 219 is located on the side in the Y-axis direction relative to the recessed portion 209C with the partition wall 211 therebetween. The recessed portion 219 is surrounded by the partition wall 211, the partition wall 213, the partition wall 216, and the partition wall 217.

In the third case 201, the recessed portion 209A is demarcated by a bottom wall 230, a first side wall 231, a second side wall 232, a third side wall 233, and a fourth side wall 234. The first side wall 231 to the fourth side wall 234 constitute inner walls of the recessed portion 209A, and project in the Z-axis direction from the bottom wall 230. Note that the first side wall 231 to the fourth side wall 234 do not need to be orthogonal to the bottom wall 230, and need only intersect the bottom wall 230. When the bottom wall 230 is viewed in a plan view in the −Z-axis direction, the first side wall 231 to the fourth side wall 234 surround the bottom wall 230. The recessed portion 209A is thereby demarcated. When the bottom wall 230 is viewed in a plan view, the first side wall 231 and the second side wall 232 extend along the X axis. When the bottom wall 230 is viewed in a plan view, the third side wall 233 and the fourth side wall 234 extend along the Y axis.

The bottom wall 230 is a part of the partition wall 218, and is a wall face within the recessed portion 209A. The first side wall 231 is a part of the partition wall 211, and is a wall face within the recessed portion 209A. The second side wall 232 is a part of the partition wall 216, and is a wall face within the recessed portion 209A. The third side wall 233 is a part of the partition wall 214, and is a wall face within the recessed portion 209A. The fourth side wall 234 is a part of the partition wall 217, and is a wall face within the recessed portion 209A. Note that the bottom wall 230 and the first side wall 231 to the fourth side wall 234 are not limited to being flat faces, and may be uneven or curved, for example.

In the third case 201, the recessed portion 209B is demarcated by a bottom wall 235, a first side wall 236, a second side wall 237, a third side wall 238, and a fourth side wall 239. The first side wall 236 to the fourth side wall 239 constitute inner walls of the recessed portion 209B, and project in the Z-axis direction from the bottom wall 235. Note that the first side wall 236 to the fourth side wall 239 do not need to be orthogonal to the bottom wall 235, and need only intersect the bottom wall 235. When the bottom wall 235 is viewed in a plan view in the −Z-axis direction, the first side wall 236 to the fourth side wall 239 surround the bottom wall 235. The recessed portion 209B is thereby demarcated. When the bottom wall 235 is viewed in a plan view, the first side wall 236 and the second side wall 237 extend along the Y axis. When the bottom wall 235 is viewed in a plan view, the third side wall 238 and the fourth side wall 239 extend along the X axis.

The bottom wall 235 is a part of the partition wall 218, and is a wall face within the recessed portion 209B. The first side wall 236 is a part of the partition wall 212, and is a wall face within the recessed portion 209B. The second side wall 237 is a part of the partition wall 214, and is a wall face within the recessed portion 209B. The third side wall 238 is a part of the partition wall 215, and is a wall face within the recessed portion 209B. The fourth side wall 239 is a part of the partition wall 211, and is a wall face within the recessed portion 209B. Note that the bottom wall 235 and the first side wall 236 to the fourth side wall 239 are not limited to being flat faces, and may be uneven or curved, for example.

In the third case 201, the recessed portion 209C is demarcated by a bottom wall 240, a first side wall 241, a second side wall 242, a third side wall 243, and a fourth side wall 244. The first side wall 241 to the fourth side wall 244 constitute inner walls of the recessed portion 209C, and project in the Z-axis direction from the bottom wall 240. Note that the first side wall 241 to the fourth side wall 244 do not need to be orthogonal to the bottom wall 240, and need only intersect the bottom wall 240. When the bottom wall 240 is viewed in a plan view in the −Z-axis direction, the first side wall 241 to the fourth side wall 244 surround the bottom wall 240. The recessed portion 209C is thereby demarcated. When the bottom wall 240 is viewed in a plan view, the first side wall 241 and the second side wall 242 extend along the Y axis. When the bottom wall 240 is viewed in a plan view, the third side wall 243 and the fourth side wall 244 extend along the X axis.

The bottom wall 240 is a part of the partition wall 218, and is a wall face within the recessed portion 209C. The first side wall 241 is a part of the partition wall 213, and is a wall face within the recessed portion 209C. The second side wall 242 is a part of the partition wall 212, and is a wall face within the recessed portion 209C. The third side wall 243 is a part of the partition wall 215, and is a wall face within the recessed portion 209C. The fourth side wall 244 is a part of the partition wall 211, and is a wall face within the recessed portion 209C. Note that the bottom wall 240 and the first side wall 241 to the fourth side wall 244 are not limited to being flat faces, and may be uneven or curved, for example.

A plurality of supply holes 141 are formed in the partition wall 218. The plurality of supply holes 141 penetrate the partition wall 218. In the present embodiment, at least one supply hole 141 is formed in each of the recessed portion 209A to the recessed portion 209C. The supply holes 141 formed in the recessed portion 209A to the recessed portion 209C penetrate between the inside of the recessed portion 209A to the recessed portion 209C and the outside of the third case 201. Ink contained in the recessed portion 209A to the recessed portion 209C is discharged to the outside of the cartridge 5B from the supply holes 141.

As shown in FIG. 13, the holding member 204A to the holding member 204C are housed respectively in the recessed portion 209A to the recessed portion 209C of the third case 201. The holding member 204A is housed in the recessed portion 209A, the holding member 204B is housed in the recessed portion 209B, and the holding member 204C is housed in the recessed portion 209C. Each of the holding member 204A to the holding member 204C has a plate shape, and has a size that allows the holding member to cover a single supply hole 141. The holding member 204A to the holding member 204C are provided at positions overlapping the respective supply holes 141 (FIG. 14), and cover the supply holes 141 from the inside of the recessed portion 209A to the recessed portion 209C. The holding member 204A is placed on the bottom wall 230 of the recessed portion 209A. The holding member 204B is placed on the bottom wall 235 of the recessed portion 209B, and the holding member 204C is placed on the bottom wall 240 of the recessed portion 209C. A material similar to that of the holding member 84 is employed as the material of the holding member 204.

As shown in FIG. 13, the three holding members 205 are provided on the side of the fourth case 202 relative to the holding members 204. That is to say, in the recessed portion 209A, the holding member 205A is present between the corresponding holding member 204 and the fourth case 202. In the recessed portion 209B, the holding member 205B is present between the corresponding holding member 204 and the fourth case 202. In the recessed portion 209C, the holding member 205C is present between the corresponding holding member 204 and the fourth case 202. The holding members 205 are constituted by a fibrous member as is the holding member 91. In each holding member 205 as well, a face opposed to the fourth case 202 is defined as a first face 151, as it is in the holding member 91. Also, in each holding member 205 as well, a face opposed to the partition wall 218 (FIG. 14) is defined as a second face 152, as it is in the holding member 91.

Figure 15:
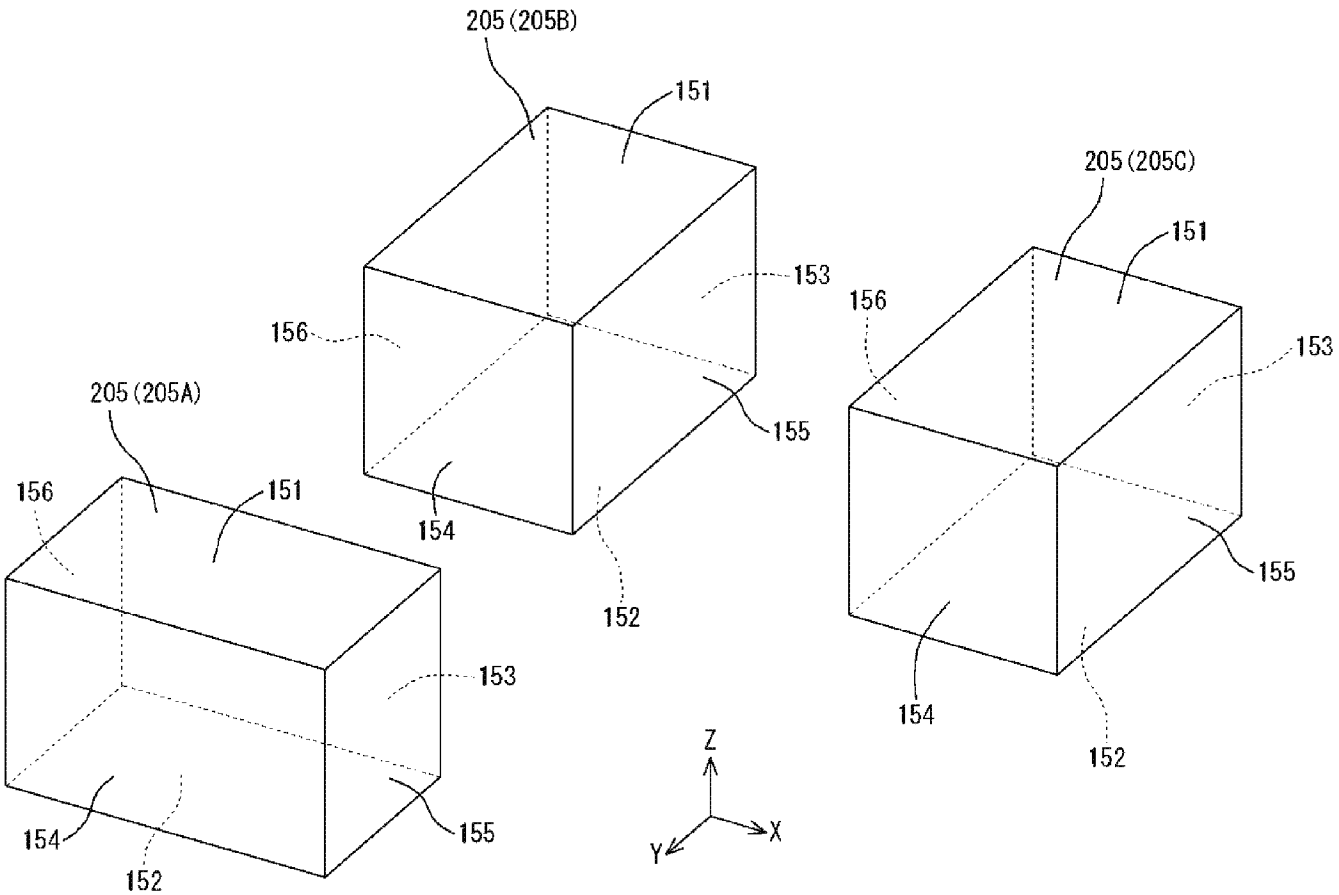
FIG. 15 is a perspective view of holding members according to the present embodiment.

As shown in FIG. 15, in each holding member 205, a face intersecting the first face 151 and the second face 152 is defined as a third face 153. A face intersecting the first face 151 and the second face 152 and opposed to the third face 153 is defined as a fourth face 154. A face intersecting the first face 151, the second face 152, the third face 153, and the fourth face 154 is defined as a fifth face 155. A face intersecting the first face 151, the second face 152, the third face 153, and the fourth face 154 and opposed to the fifth face 155 is defined as a sixth face 156. In each holding member 205 as well, the first face 151 to the sixth face 156 are not limited to being flat faces, and may be uneven or curved, for example.

In the holding member 205A, the third face 153 is defined as a face opposed to the first side wall 231 (FIG. 14), and the fourth face 154 is defined as a face opposed to the second side wall 232. Similarly, in the holding member 205A, the fifth face 155 is defined as a face opposed to the fourth side wall 234, and the sixth face 156 is defined as a face opposed to the third side wall 233. In the holding member 205B, the third face 153 is defined as a face opposed to the third side wall 238 (FIG. 14), and the fourth face 154 is defined as a face opposed to the fourth side wall 239. Similarly, in the holding member 205B, the fifth face 155 is defined as a face opposed to the first side wall 236, and the sixth face 156 is defined as a face opposed to the second side wall 237. In the holding member 205C, the third face 153 is defined as a face opposed to the third side wall 243 (FIG. 14), and the fourth face 154 is defined as a face opposed to the fourth side wall 244. Similarly, in the holding member 205C, the fifth face 155 is defined as a face opposed to the first side wall 241, and the sixth face 156 is defined as a face opposed to the second side wall 242.

Here, the three recessed portions 209 of the third case 201 (FIG. 13) are configured to be further narrowed in the −Z-axis direction from the side of the fourth case 202. Each of the three holding members 205 is formed to be larger than each recessed portion 209. For this reason, upon the holding members 205 being housed in the respective recessed portions 209, the holding members 205 are compressed as the holding members 205 move toward the partition wall 218

(FIG. 14). As a result, in the recessed portions 209, the capillary force of the holding members 205 increases from the side of the fourth case 202 toward the side of the partition wall 218.

Figure 16:
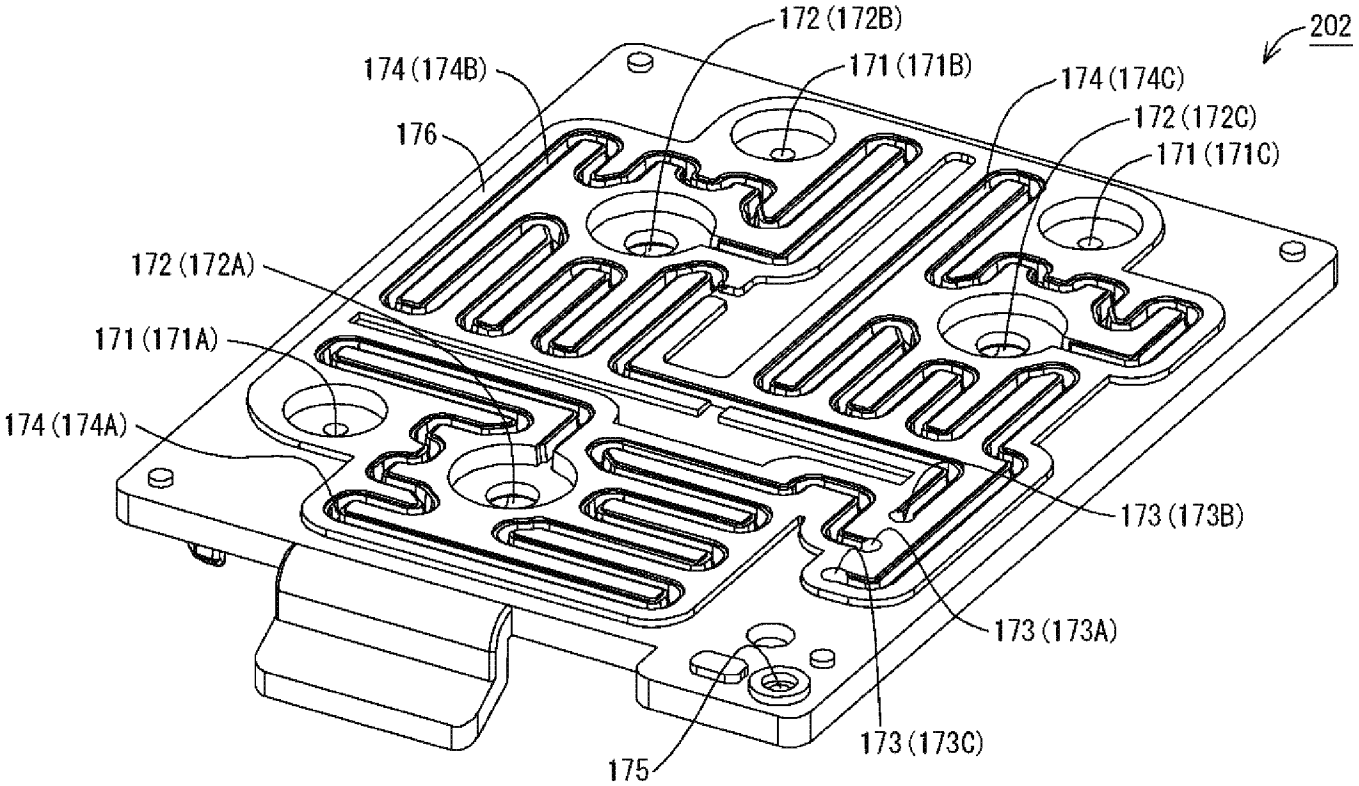
FIG. 16 is a perspective view of a fourth case according to the present embodiment.

As shown in FIG. 16, the fourth case 202 has a plate-like appearance, and has three injection holes 171, three communication holes 172, three relay holes 173, three introduction grooves 174, an introduction hole 175, and a bank portion 176. The injection holes 171, the communication holes 172, the relay holes 173, the introduction grooves 174, the introduction hole 175, and the bank portion 176 have a function similar to that of the second case 83 of the cartridge 5A, and accordingly detailed descriptions thereof will be omitted. The sheet member 203 is joined to the fourth case 202 from the side in the Z-axis direction relative to the fourth case 202. Since the sheet member 203 also has a function similar to that of the sheet member 95 of the cartridge 5A, detailed description thereof will be omitted.

Hereinafter, in the case of identifying each of the three injection holes 171, the three injection holes 171 are referred to individually as an injection hole 171A, an injection hole 171B, and an injection hole 171C. In the case of identifying each of the three communication holes 172, the three communication holes 172 are referred to individually as a communication hole 172A, a communication hole 172B, and a communication hole 172C. In the case of identifying each of the three relay holes 173, the three relay holes 173 are referred to individually as a relay hole 173A, a relay hole 173B, and a relay hole 173C. In the case of identifying each of the three introduction grooves 174, the three introduction grooves 174 are referred to individually as an introduction groove 174A, an introduction groove 174B, and an introduction groove 174C.

In the cartridge 5B as well, the injection hole 171A, the communication hole 172A, the relay hole 173A, and the introduction groove 174A correspond to the recessed portion 209A. The injection hole 171B, the communication hole 172B, the relay hole 173B, and the introduction groove 174B correspond to the recessed portion 209B. The injection hole 171C, the communication hole 172C, the relay hole 173C, and the introduction groove 174C correspond to the recessed portion 209C. Note that the cartridge 5B is provided with a single introduction hole 175. Note that the introduction hole 175 is in communication with the three relay holes 173 via the recessed portion 219 (FIG. 14) of the third case 201. For this reason, the three recessed portions 209 are in communication with the atmosphere via the single introduction hole 175.

Figure 17:
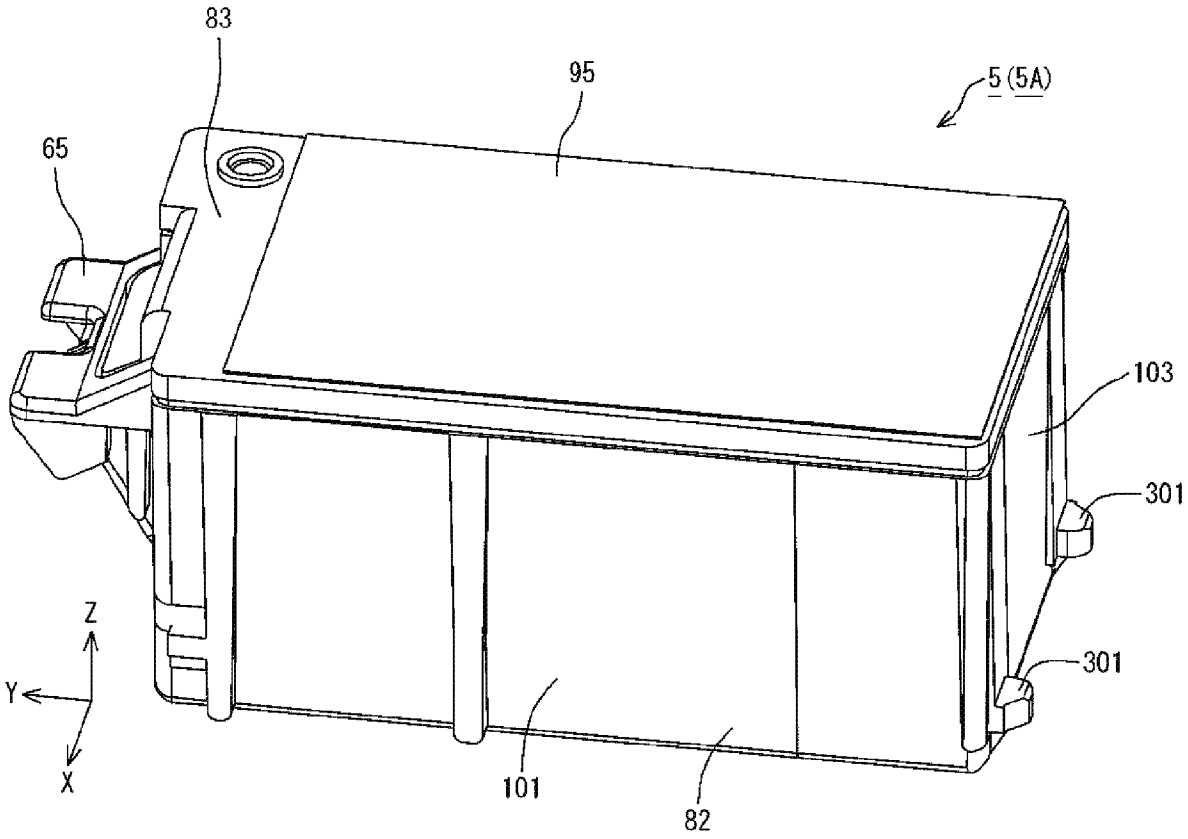
FIG. 17 is a perspective view of the cartridge according to the present embodiment.

A method (attachment method) for attaching the cartridges 5 to the holder 31 will now be described. In the present embodiment, the method for attaching the cartridge 5A is the same as the method for attaching the cartridge 5B. For this reason, the method for attaching the cartridge 5A will be described below. As shown in FIG. 17, the cartridge 5 is provided with two engaging projection portions 301 in the partition wall 103 of the first case 82. The two engaging projection portions 301 are arranged side-by-side along the X axis. The two engaging projection portions 301 project in the −Y-axis direction from the partition wall 103. The two engaging projection portions 301 are located in the −Z-axis direction relative to an end portion of the partition wall 103 in the Z-axis direction. The two engaging projection portions 301 are located in the −Z-axis direction relative to the engaging portion 65.

Figure 18:
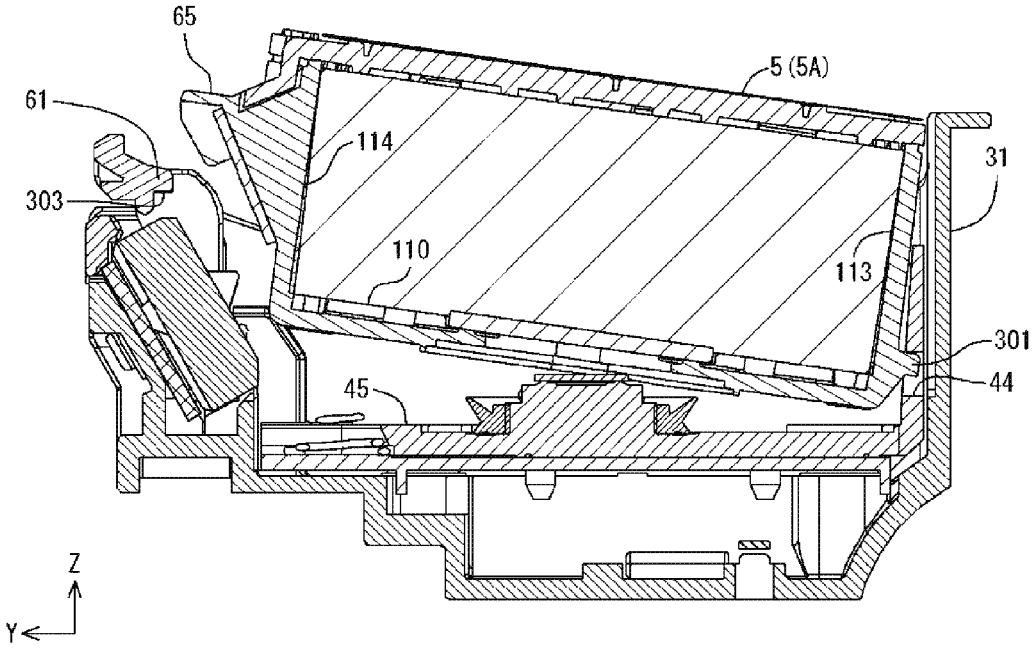
FIG. 18 is a diagram illustrating a method for attaching the cartridge to the holder according to the present embodiment.

In the attachment method according to the present embodiment, initially, as shown in FIG. 18, the cartridge 5 is inserted into the holder 31 in a state where the cartridge 5 is inclined relative to the holder 31. At this time, the bottom wall 110 of the cartridge 5 is inclined relative to the bottom portion 45 of the holder 31. At this time, the bottom wall 110 is inclined in an orientation in which the bottom wall 110 is closer to the bottom portion 45 on the side of the third side wall 113 than on the side of the fourth side wall 114. In the state where the cartridge 5 is inclined relative to the holder 31, the engaging projection portions 301 are inserted into the engaging holes 44 while bringing the cartridge 5 close to the bottom portion 45. Note that FIG. 18 shows a state where the engaging portion 65 of the cartridge 5 is located in the Z-axis direction relative to the engaging portion 303 of the engagement lever 61 of the holder 31.

Figure 19:
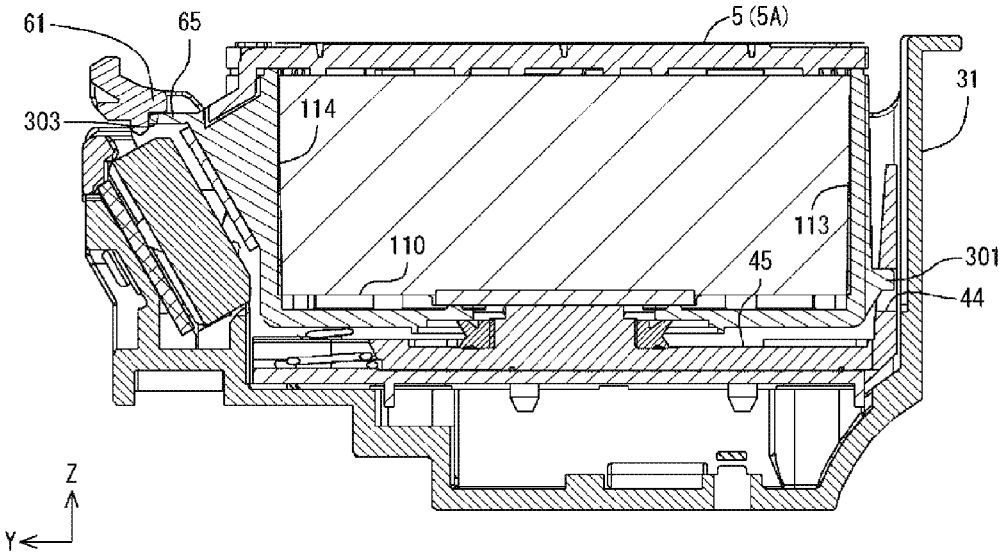
FIG. 19 is a diagram illustrating a method for attaching the cartridge to the holder according to the present embodiment.

Next, in the state shown in FIG. 18, the cartridge 5 is rotated (pivoted) in an orientation in which the engaging portion 65 is brought close to the bottom portion 45, i.e., so as to press the side of the fourth side wall 114 into the recessed portion 43 of the holder 31, with the engaging projection portions 301 inserted in the engaging holes 44 as a pivot fulcrum. Then, the engaging portion 65 is displaced in the −Z-axis direction relative to the engaging portion 303 of the engagement lever 61. Thereby, as shown in FIG. 19, the engaging portion 65 engages with the engaging portion 303 of the engagement lever 61. As a result of the engaging portion 65 engaging with the engaging portion 303 of the engagement lever 61, the attachment of the cartridge 5 to the holder 31 is completed. Upon the engaging portion 65 engaging with the engaging portion 303 of the engagement lever 61, the position of the cartridge 5 in the Z-axis direction is restricted.

Figure 20:
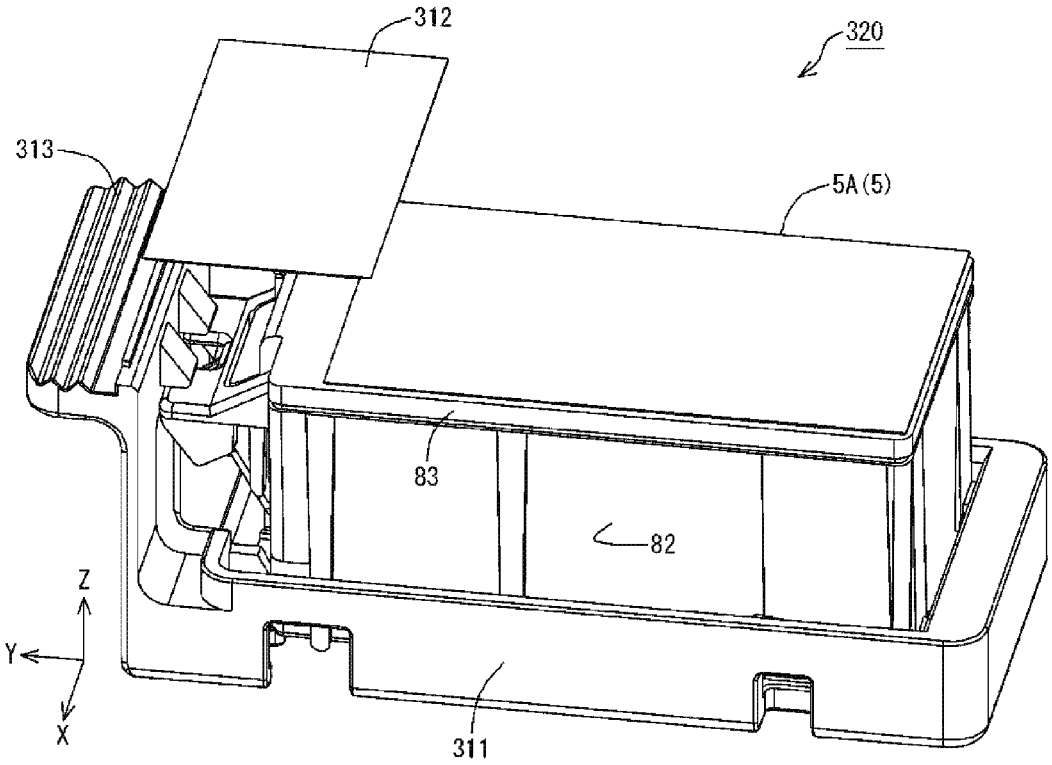
FIG. 20 is a perspective view of an ink supply set according to the present embodiment.

Note that in the present embodiment, a cap 311 and a film material 312 are attached to the cartridge 5A, as shown in FIG. 20. When the cartridge 5A is unused, the cap 311 is attached to the cartridge 5A. The cap 311 is an exemplary protection member. The film material 312 is joined to the cap 311 and the cartridge 5A while being spanned between an operation portion 313 of the cap 311 and the second case 83 of the cartridge 5A. In the present embodiment, a set including the cartridge 5A, the cap 311, and the film material 312 is called an ink supply set 320. An unused cartridge 5A is provided as the ink supply set 320. The ink supply set 320 is an exemplary liquid supply unit set. The ink supply set 320 is an exemplary distribution mode of the cartridge 5A.

The cap 311 closes the supply hole 141 (FIG. 5) of the cartridge 5A. By closing the supply hole 141 using the cap 311, it is possible to significantly suppress the leakage of ink from the supply hole 141 and the evaporation of liquid components of the ink from the supply hole 141. Note that when attaching the cartridge 5A to the printer 3, an operator removes the cap 311 and the film material 312 from the cartridge 5A and thereafter attaches the cartridge 5A to the printer 3. That is to say, the cartridge 5A is attached to the printer 3 in a state where the cap 311 has been removed from the supply hole 141.

Figure 21:
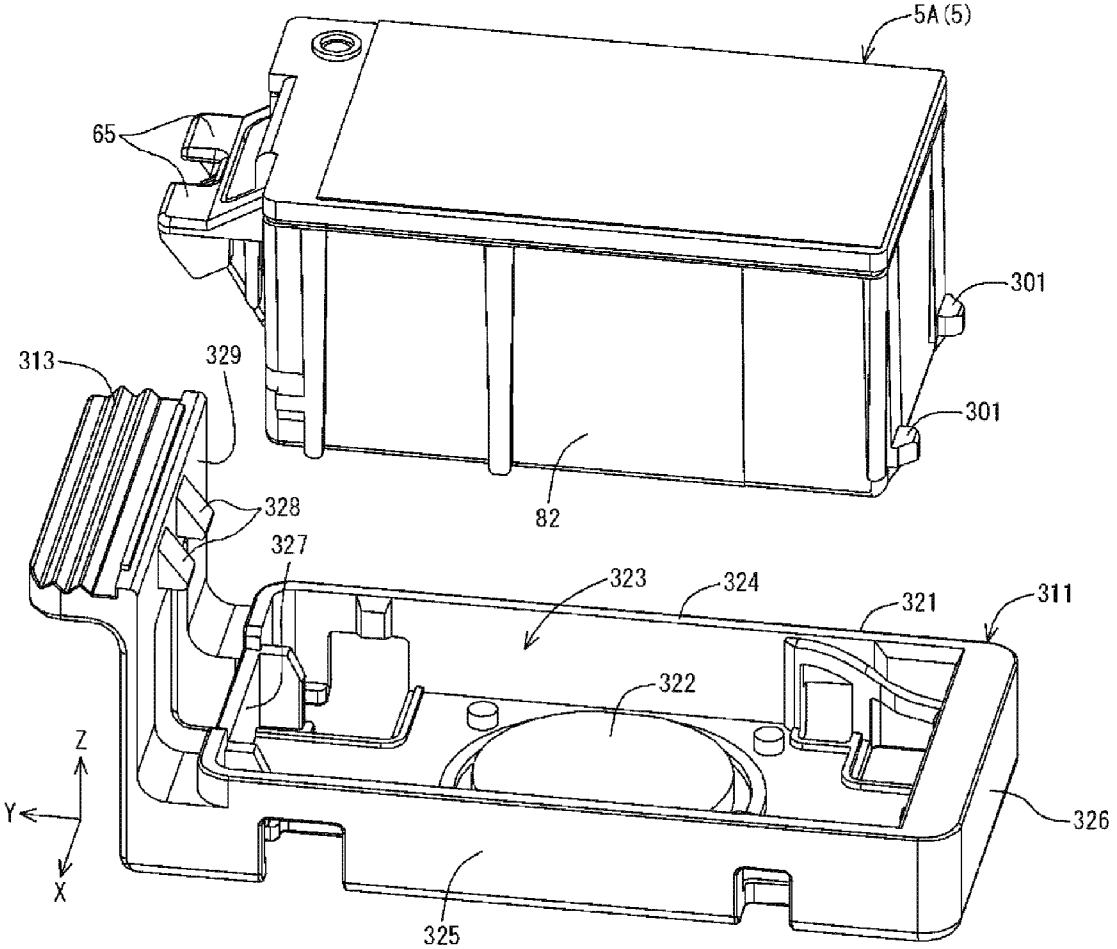
FIG. 21 is a perspective view of the cartridge and a cap according to the present embodiment.

As shown in FIG. 21, the cap 311 has a cover 321 and a seal member 322, which is an exemplary sealing portion. The cover 321 is formed with synthetic resin such as nylon or polypropylene, for example. The cover 321 is provided with a recessed portion 323 and the operation portion 313. The recessed portion 323 is provided so as to be recessed in the −Z-axis direction. The recessed portion 323 is open in the Z-axis direction. When the recessed portion 323 is viewed in a plan view in the −Z-axis direction, the recessed portion 323 has a size that allows the recessed portion 323 to receive the second case 83 of the cartridge 5A. The recessed portion 323 is surrounded by a partition wall 324, a partition wall 325, a partition wall 326, and a partition wall 327. The partition wall 324 and the partition wall 325 face each other while forming a gap therebetween along the X axis. The partition wall 326 and the partition wall 327 face each other while forming a gap therebetween along the Y axis.

The seal member 322 is housed in the recessed portion 323. The operation portion 313 is provided on the side opposite to the side of the seal member 322 relative to the partition wall 327, i.e., in the Y-axis direction relative to the partition wall 327. The operation portion 313 extends in the Z-axis direction. The operation portion 313 is provided with engaged pawls 328, which are exemplary engagement portions. The engaged pawls 328 are provided on a face 329 of the operation portion 313 that is oriented to the side of the recessed portion 323, i.e., the face 329 of the operation portion 313 that is oriented in the −Y direction. The engaged pawls 328 project in the −Y-axis direction from the face 329. The engaged pawls 328 are located in the Z-axis direction relative to end portions of the partition wall 324 to the partition wall 327 in the Z-axis direction. The engaged pawls 328 are configured to be able to engage with the engaging portion 65 of the cartridge 5A. Note that the face 329 is located in the Y-axis direction relative to the partition wall 327. That is to say, a gap is provided along the Y axis between the partition wall 327 and the face 329.

Figure 22:
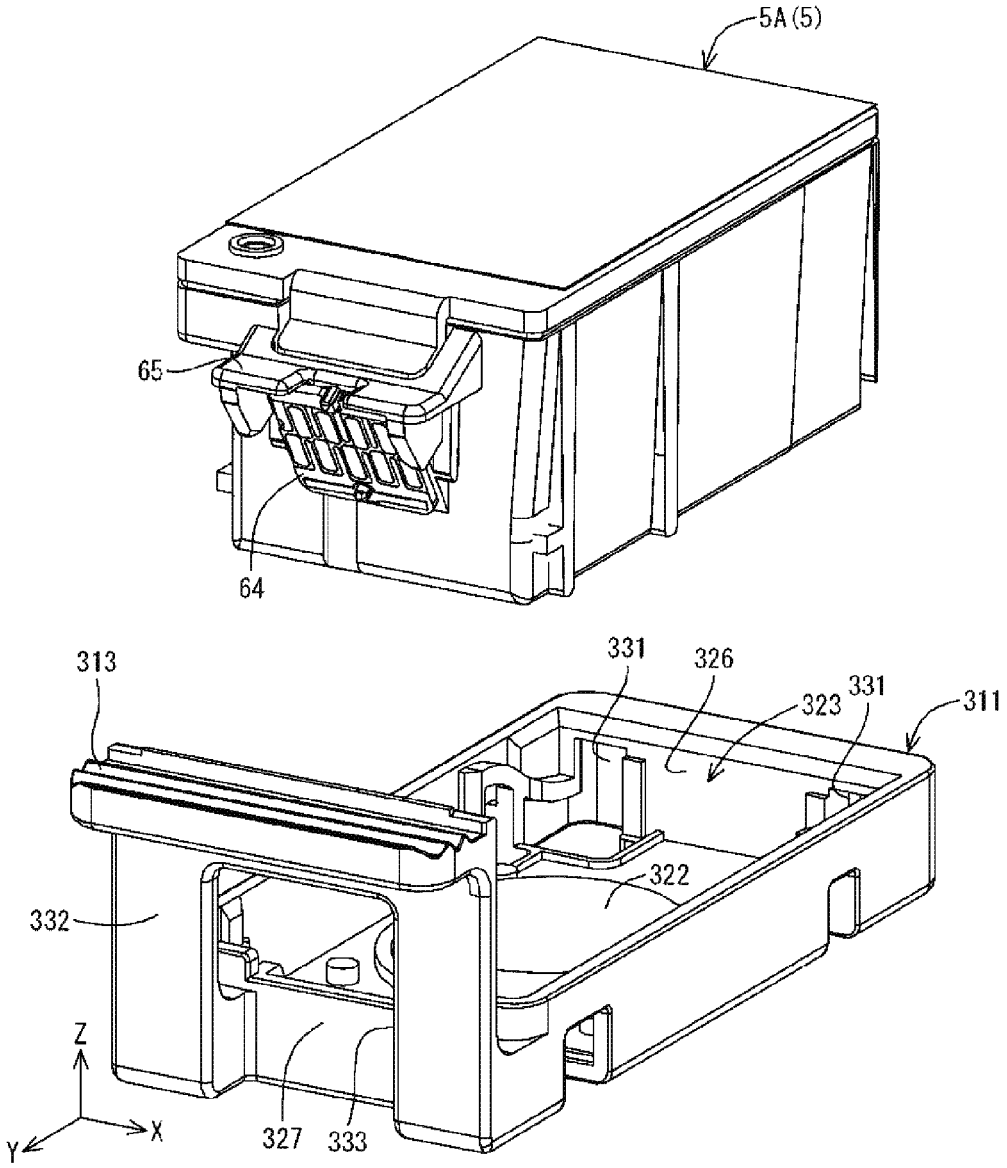
FIG. 22 is a perspective view of the cartridge and the cap according to the present embodiment.

As shown in FIG. 22, in the cap 311, engaging holes 331 are formed in the partition wall 326. An opening 333 is formed in a side wall 332 of the operation portion 313. The side wall 332 is opposed to the partition wall 327. The opening 333 is formed from a portion opposed to the partition wall 327 up to a portion located in the Z-axis direction relative to the partition wall 327. For this reason, when the side wall 332 of the cap 311 is viewed in the −Y-axis direction, a part of the partition wall 327 can be visually recognized via the opening 333. In the partition wall 326, the engaging holes 331 are formed so as to be recessed in the −Y-axis direction from the inside of the recessed portion 323. The engaging holes 331 are configured such that the engaging projection portions 301 (FIG. 17) of the cartridge 5A can be inserted therein.

The cap 311 is attached to the cartridge 5A by inserting the engaging projection portions 301 (FIG. 21) of the cartridge 5A into the engaging holes 331 (FIG. 22) of the cap 311, and engaging the engaged pawls 328 (FIG. 21) of the cap 311 with the engaging portion 65 of the cartridge 5A. At this time, the side wall 332 of the cap 311 is located in the Y-axis direction relative to the circuit board 64 (FIG. 22) of the cartridge 5A. For this reason, as a result of attaching the cap 311 to the cartridge 5A, the circuit board 64 can be protected by the side wall 332 of the cap 311.

In a state where the cap 311 is attached to the cartridge 5A, the supply hole 141 (FIG. 5) is covered with the cover 321 of the cap 311. At this time, the supply hole 141 (FIG. 5) is closed by the seal member 322 of the cap 311. Note that the engaged pawls 328 can be removed from the engaging portion 65 by bending the operation portion 313 to the side opposite to the side of the cartridge 5A (i.e., in the Y-axis direction) in a state where the cap 311 is attached to the cartridge 5A. The cap 311 can thereby be removed from the cartridge 5A.

Figure 23:
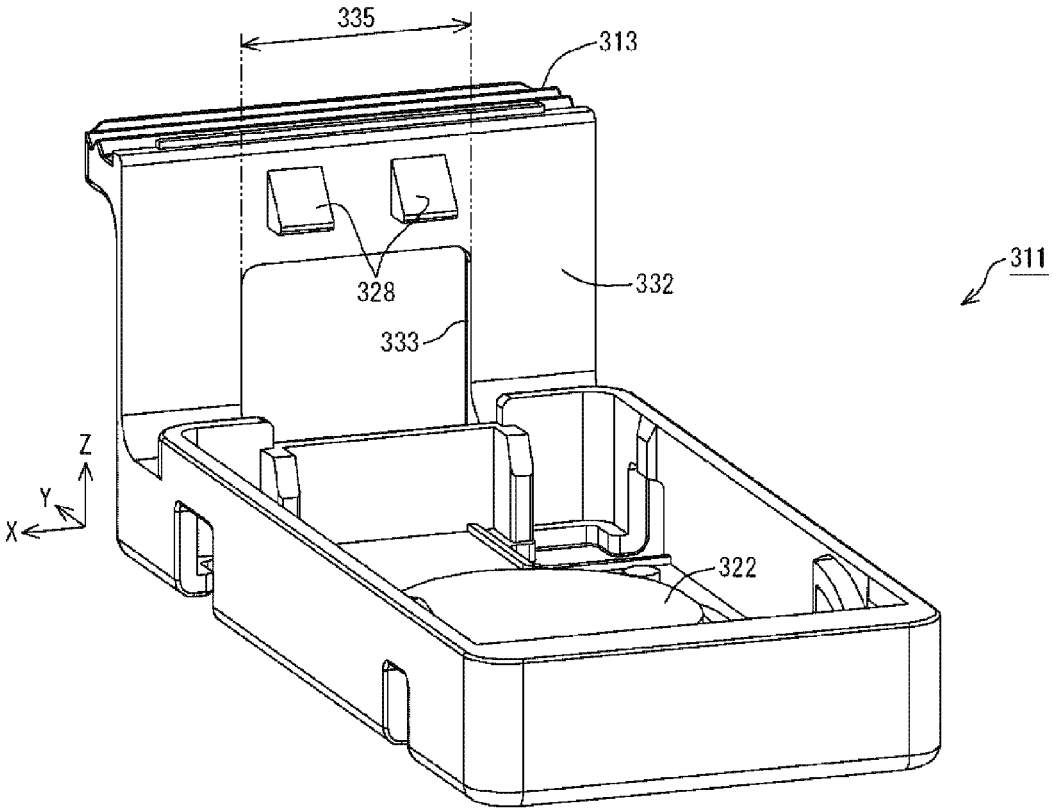
FIG. 23 is a perspective view of the cap according to the present embodiment.

Here, as shown in FIG. 23, the engaged pawls 328 of the cap 311 are located in the Z-axis direction relative to the opening 333 in the side wall 332. In the present embodiment, the engaged pawls 328 of the cap 311 are located within a region 335 formed by extending the opening 333 in the direction extending from the seal member 322 toward the supply hole 141, i.e, in the Z-axis direction, in a state where the side wall 332 is viewed in the Y-axis direction. Meanwhile, the engaging portion 65 of the cartridge 5A is located in the Z-axis direction relative to the circuit board 64, as shown in FIG. 22. In the present embodiment, the regions of the engaging portion 65 and the circuit board 64 overlap each other in a state where the cartridge 5A is viewed in the −Y-axis direction.

Figure 24:
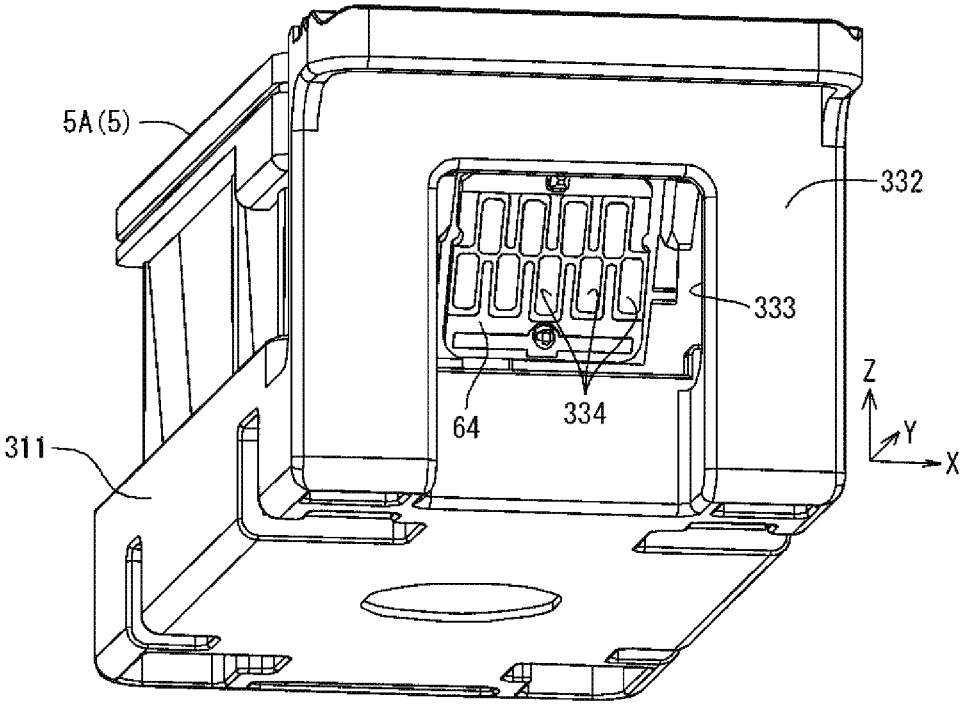
FIG. 24 is a perspective view of the cartridge and the cap according to the present embodiment.

In a state where the cap 311 is attached to the cartridge 5A, the opening 333 is formed in a region opposed to the circuit board 64. For this reason, when the side wall 332 of the cap 311 is viewed in the −Y-axis direction, a plurality of terminal portions 334 can be visually recognized via the opening 333, as shown in FIG. 24. With this configuration, in a state where the cap 311 is attached to the cartridge 5A, the terminal portions 334 of the cartridge 5A can be touched from the Y-axis direction relative to the side wall 332 via the opening 333. As a result, in a state where the cap 311 is attached to the cartridge 5A, an electrical test can be conducted on the circuit board 64 via the terminal portions 334 from the Y-axis direction relative to the side wall 332, i.e., from the outside of the cap 311.

In the present embodiment, at least a part of the engaged pawls 328 of the cap 311 that includes a portion for engaging with the engaging portion 65 of the cartridge 5A overlaps the region of the opening 333 in the direction extending from the seal member 322 toward the engaged pawls 328 in a state where the side wall 332 is viewed in the Y-axis direction. With this configuration, position accuracy of the opening 333 relative to the terminal portions 334 can be more easily improved compared with the case where the engaged pawls 328 are located at positions out of the region of the opening 333 in the Z-axis direction.

Note that in the present embodiment, as shown in FIG. 23, the engaged pawls 328 of the cap 311 are located within a region 335 formed by extending the opening 333 in the direction (the Z-axis direction) from the seal member 322 toward the supply hole 141 in a state where the side wall 332 is viewed in the Y-axis direction. However, from the viewpoint of improving the position accuracy of the opening 333 relative to the terminal portions 334, at least a part of the engaged pawls 328 that includes a portion for engaging with the engaging portion 65 of the cartridge 5A need only be located within the region 335 formed by extending the opening 333 in the Z-axis direction in a state where the side wall 332 is viewed in the Y-axis direction. For this reason, the engaged pawls 328 of the cap 311 may protrude from the region 335 formed by extending the opening 333 in the Z-axis direction in a state where the side wall 332 is viewed in the Y-axis direction. Although the two engaged pawls 328 are formed in the present embodiment, the number of engaged pawls 328 may be one or three, or greater.

Figure 25:
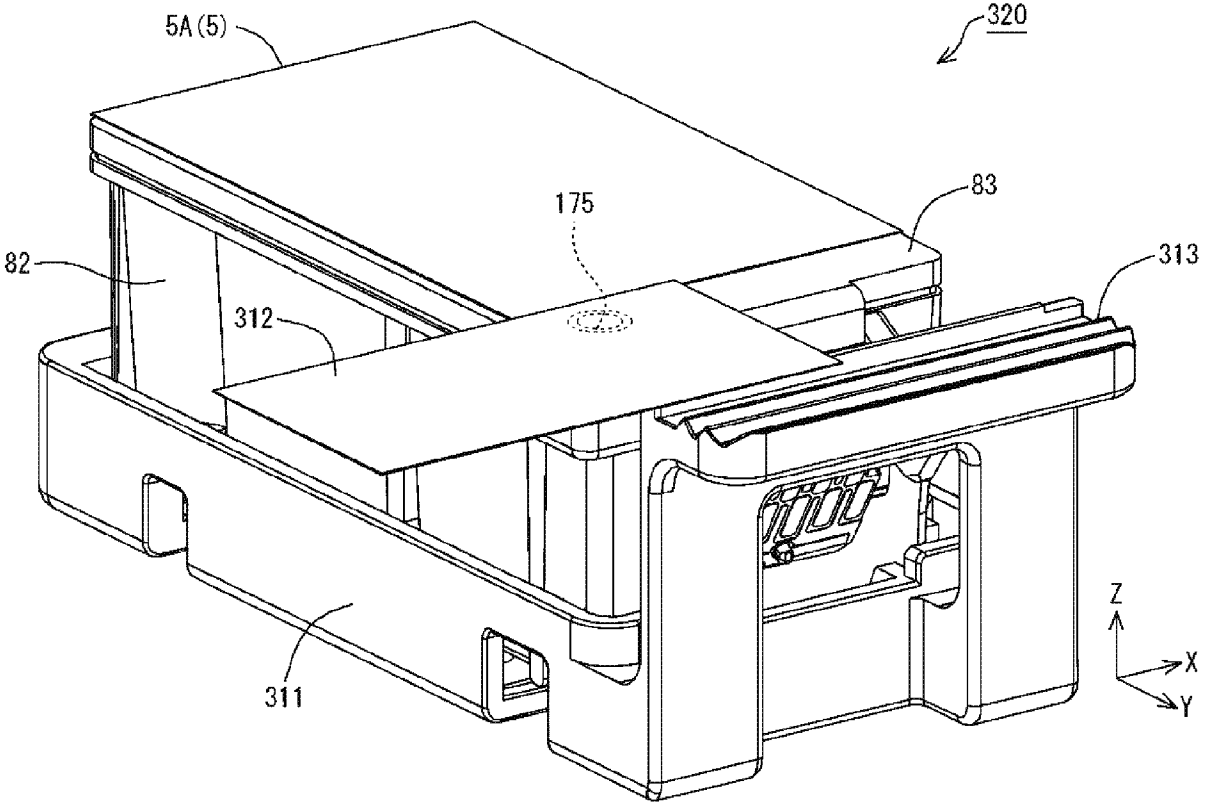
FIG. 25 is a perspective view of the ink supply set according to the present embodiment.

As shown in FIG. 25, in the cartridge 5A to which the cap 311 is attached, the film material 312 spans between the operation portion 313 of the cap 311 and the second case 83 of the cartridge 5A and joined thereto. In the present embodiment, the film material 312 is joined to the operation portion 313 of the cap 311 and the second case 83 of the cartridge 5A by adhesion. In the cap 311, the film material 312 is joined to an end portion of the operation portion 313 in the Z-axis direction. In the cartridge 5A, the film material 312 is joined to a region of the second case 83 that overlaps the introduction hole 175. In the present embodiment, the introduction hole 175 of the second case 83 is sealed by the film material 312.

With the above configuration, in the present embodiment, it is difficult to bend the operation portion 313 of the cap 311 to the side opposite to the side of the cartridge 5A (i.e., in the Y-axis direction) in a state where the film material 312 is connected thereto. This is because displacement of the operation portion 313 is restricted by the film material 312 as a result of the operation portion 313 and the cartridge 5A being coupled to each other by the film material 312. In other words, movement of the operation portion 313 is locked by the film material 312. Thereby, movement of the operation portion 313 is restricted by the film material 312 even if the operation portion 313 is operated in a state where the film material 312 is joined thereto, and it is therefore difficult to remove the cap 311 from the cartridge 5A. Accordingly, the order is defined in which the film material 312 is removed and thereafter the cap 311 is removed from the cartridge 5A. As a result, when opening the cartridge 5A, the order can be defined as one in which the introduction hole 175 is released and thereafter the cap 311 is removed. Thereby, for example, it is easy to avoid the leakage of the ink in the cartridge 5A from the supply hole 141 as a result of removing the cap 311 and then releasing the introduction hole 175.

Figure 26:
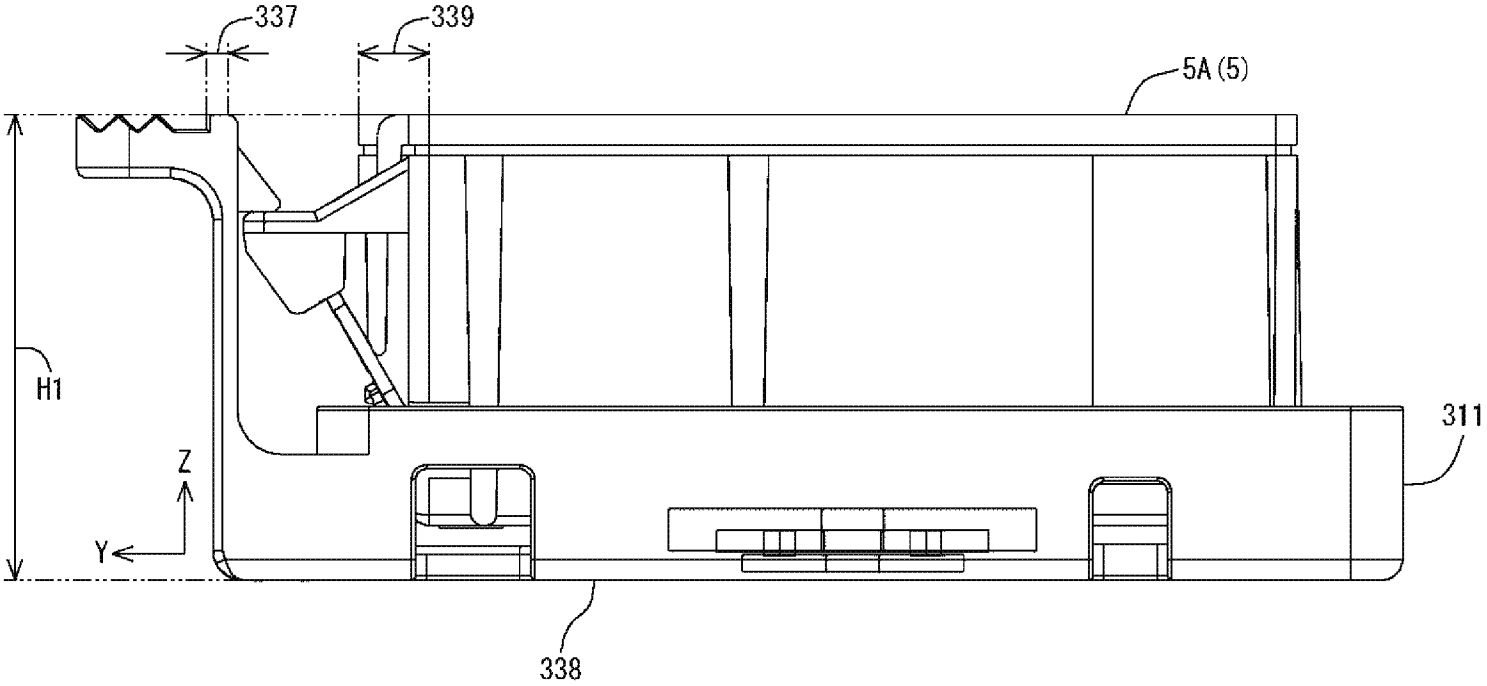
FIG. 26 is a side view of the cartridge and the cap according to the present embodiment.

Note that in the present embodiment, as shown in FIG. 26, the distance between a bottom face 338 of the cap 311 and a region 337 of the operation portion 313 of the cap 311 to which the film material 312 is joined is set to be substantially the same as the distance between the bottom face 338 of the cap 311 and a region 339 of the cartridge 5A to which the film material 312 is joined. With this setting, the joint position (joint height H1) from the bottom face 338 when attaching the film material 312 in the region 337 is substantially the same as that in the region 339, and accordingly the film material 312 can be easily adhered.

Regarding the above-described ink supply set 320, an exemplary configuration is described in which the cap 311 and the film material 312 are applied to the cartridge 5A. However, the configuration of the ink supply set 320 is not limited thereto. For the ink supply set 320, a configuration in which the cap 311 and the film material 312 are applied to the cartridge 5B may also be employed. In this case, the cap 311 to be applied to the cartridge 5B has a configuration similar to that of the cap 311 to be applied to the cartridge 5A, except that the number of seal members 322 and the size of the recessed portion 323 with which the cartridge 5 can be received are different. For this reason, detailed descriptions of the cap 311 to be applied to the cartridge 5B will be omitted. In the ink supply set 320 in which the cap 311 and the film material 312 are applied to the cartridge 5B as well, an effect similar to that of the ink supply set 320 in which the cap 311 and the film material 312 are applied to the cartridge 5A is achieved.

Figure 27A:
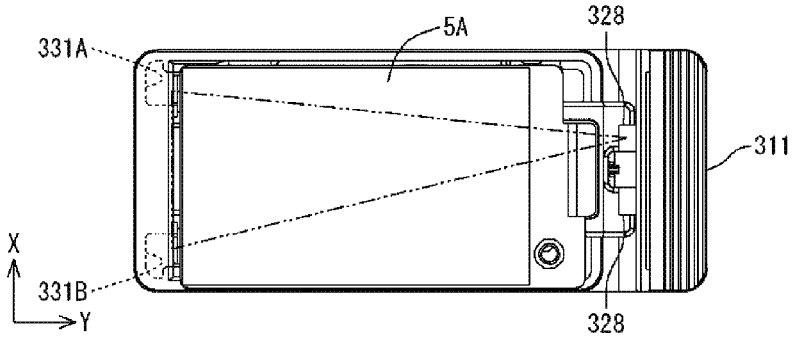
FIGS. 27A to 27D are plan views of the cartridge and the cap according to the present embodiment.
Figure 27B:
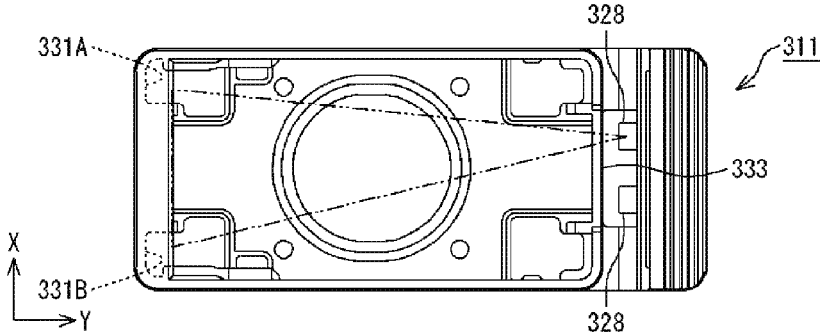
Figure 27C:
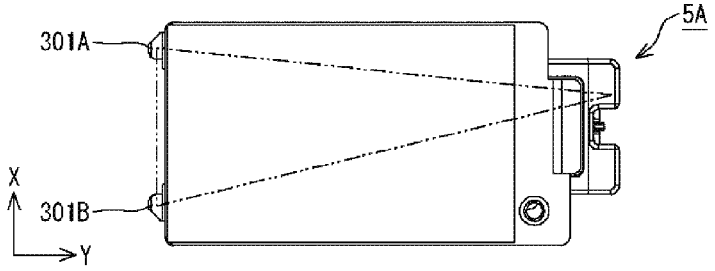
Figure 27D:
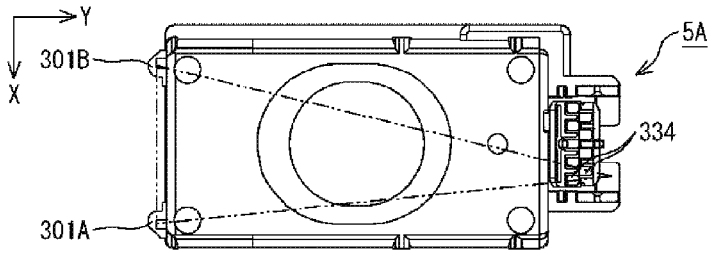
Figure 28:
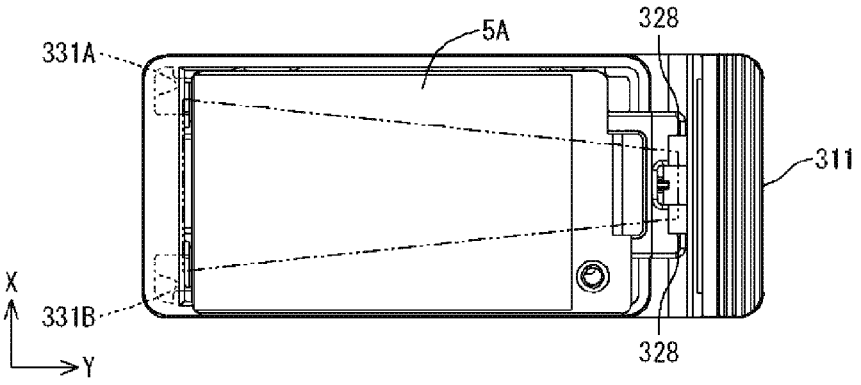
FIG. 28 is a plan view of the cap and the cartridge as viewed in a direction extending from a supply hole toward a seal member in a state where the cap according to the present embodiment is attached to the cartridge.

FIG. 27A is a diagram showing the cap 311 and the cartridge 5A as viewed in a plan view in a direction extending from the supply hole 141 toward the seal member 322 in a state where the cap 311 is attached to the cartridge 5A. FIG. 27B is a diagram showing the cap 311 as viewed in a plan view in the direction extending from the supply hole 141 toward the seal member 322 in a state where the cap 311 is attached to the cartridge 5A. FIG. 27C is a diagram showing the cartridge 5A as viewed in a plan view in the direction extending from the supply hole 141 toward the seal member 322 in a state where the cap 311 is attached to the cartridge 5A. FIG. 27D is a diagram showing the cartridge 5A as viewed in a plan view in a direction extending from the seal member 322 toward the supply hole 141 in a state where the cap 311 is attached to the cartridge 5A. FIG. 28 is a diagram showing the cap 311 and the cartridge 5A as viewed in a plan view in the direction extending from the supply hole 141 toward the seal member 322 in a state where the cap 311 is attached to the cartridge 5A.

At this time, in the cap 311, the engaged pawls 328, the engaging hole 331*a*, and the engaging hole 331*b* are arranged such that at least a part of the terminal portions 334 is located in a region formed by connecting the engaged pawls 328, the engaging hole 331*a*, and the engaging hole 331*b* using straight lines. This region is also a region in which the position of the cap 311 relative to the cartridge 5A is most stable when the cap 311 is attached to the cartridge 5A. With an arrangement in which at least a part of the terminal portions 334 is located in this region, a shift in the position of the terminal portions 334 relative to the opening 333 can be suppressed.

FIGS. 27A to 27D show a triangular region formed by connecting, using straight lines, a contacting portion between a part of the engaging portion 65 of the cartridge 5A and one of the engaged pawls 328 of the cap 311, a contacting portion between one of the engaging projection portions 301 of the cartridge 5A and the engaging hole 331*a* of the cap 311, and a contacting portion between the other one of the engaging projection portions 301 of the cartridge 5A and the engaging hole 331*b* of the cap 311 to one another. FIG. 28 shows an example in which at least a part of the terminal portions 334 is located in a rectangular region formed by further connecting, using straight lines, a contacting portion between another part of the engaging portion 65 of the cartridge 5A and the other one of the engaged pawls 328 of the cap 311. In the case where at least a part of the terminal portions 334 is arranged in this rectangular region as well, the position of the terminal portions 334 relative to the opening 333 can be stabilized.

Note that in the present embodiment, the partition wall 105 corresponds to a first partition wall, the partition wall 104 corresponds to a second partition wall, the partition wall 103 corresponds to a third partition wall, the engaging portion 65 corresponds to a first engaging portion, the two engaging projection portions 301 correspond to a second engaging portion and a third engaging portion, the bottom face 338 corresponds to a bottom wall, the engaged pawls 328 each correspond to a first engagement portion, the side wall 332 corresponds to a first side wall, the two engaging holes 331 correspond to a second engagement portion and a third engagement portion, and the partition wall 326 corresponds to a second side wall.

Modification 1

Figure 29:
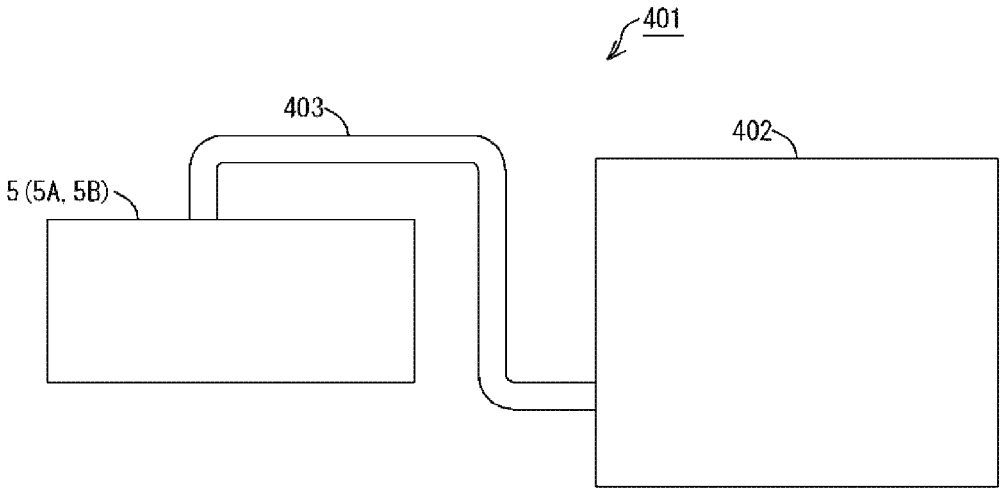
FIG. 29 is a diagram illustrating a configuration of a liquid supply unit according to Modification 1.

The liquid supply unit for supplying liquid to the liquid ejection apparatus is not limited to the cartridge 5 that is an exemplary liquid supply unit. Another exemplary liquid supply unit will now be described as Modification 1. As shown in FIG. 29, a liquid supply unit 401 according to Modification 1 has the above-described cartridge 5, a tank 402, and a supply tube 403. The tank 402 contains ink to be supplied to the above-described cartridge 5. The supply tube 403 guides the liquid from the tank 402 to the cartridge 5. The supply tube 403 is flexible. The cartridge 5 in the liquid supply unit 401 according to Modification 1 can also employ the ink supply set in which the cap 311 and the film material 312 are applied. According to Modification 1 as well, an effect similar to that of the above-described ink supply set 320 can be achieved.

In the liquid supply unit 401 according to Modification 1, the cartridge 5 is installed in a carriage unit 25 (FIG. 3), whereas the tank 402 is provided independently from the carriage unit 25. That is to say, according to Modification 1, the tank 402 is not installed in the carriage unit 25. For this reason, it is possible to increase the amount of ink that can be supplied to the liquid ejection apparatus, while reducing a load placed on the carriage unit 25. Furthermore, with a configuration in which new ink can be supplied to the tank 402, it is possible to shorten or eliminate the stop time of the liquid ejection apparatus when the ink runs out.

Modification 2

The cartridges 5 according to the above-described embodiment and Modification 1 employ a configuration in which the ink is held by the holding member 84, the holding member 91, the holding member 204, and the holding member 205. However, the configuration of the cartridge 5 is not limited thereto. For example, the cartridge 5 may employ a configuration (which is deemed to be Modification 2) in which the holding member 84, the holding member 91, the holding member 204, and the holding member 205 are not provided.

The invention is applicable not only to inkjet printers and ink cartridges thereof, but also to any printers (liquid discharge apparatuses) that eject (discharge) liquid other than ink and cartridges thereof. For example, the invention is applicable to various printers such as those listed below and cartridges thereof.

(1) Image recording apparatuses such as a facsimile apparatus; (2) Printers that eject color materials used to manufacture color filters for image display apparatuses such as a liquid crystal display; (3) Printers that eject electrode materials used to form electrodes of organic EL (Electro Luminescence) displays, field emission displays (FEDs), and the like; (4) Printers that eject liquid containing biological organic matter used to manufacture biochips; (5) Sample printers serving as precision pipettes; (6) Lubricating oil printers; (7) Resin solution printers; (8) Printers that perform pinpoint ejection of lubricating oil to precision machines such as a watch and a camera; (9) Printers that eject transparent resin solution such as UV-cured resin solution onto substrates in order to form micro-hemispherical lenses (optical lenses) used in optical communication elements and the like; (10) Printers that eject acid or alkaline etchant in order to etch substrates and the like; and (11) Any other printers provided with a liquid ejection head (liquid discharge head) that discharges a very small amount of droplets.

Note that "droplet" refers to a state of the liquid discharged from a printer, and includes droplets having a granular shape, a tear-drop shape, and a shape having a thread-like trailing end. Furthermore, the "liquid" need only be any kind of material that can be ejected by a printer. For example, the "liquid" need only be a material in a state where a substance is in a liquid phase, and a liquid material having a high or low viscosity, sol, gel water, and other liquid materials such as inorganic solvent, organic solvent, solution, liquid resin, and liquid metal (metallic melt) are also included as a "liquid". Furthermore, the "liquid" is not limited to being a single-state substance, and also includes particles of a functional material made from solid matter, such as pigment or metal particles, that are dissolved, dispersed, or mixed in a solvent, and the like. The above "liquid" can also be expressed as a "liquid body". Representative examples of the liquid and liquid body include ink, such as the ink described in the above embodiment, and liquid crystal. Here, the "ink" encompasses general water-based ink and oil-based ink, as well as various types of liquid compositions such as gel ink and hot melt-ink.

The entire disclosure of Japanese Patent Application No. 2014-247691 filed on Dec. 8, 2014, is expressly incorporated by reference herein.

What is claimed is:

1. A protection member for attachment to a liquid supply unit including: a liquid supply portion that supplies the liquid to a liquid ejection apparatus; a terminal portion electrically connected to an electrical connection portion provided in the liquid ejection apparatus; and an engaging portion that engages with the liquid ejection apparatus, the protection member comprising:

a sealing portion that seals the liquid supply portion;

an engagement portion that engages with the engaging portion; and an opening provided in a portion opposed to the terminal portion such that at least apart of the terminal portion is exposed through the opening in a state where the protection member is attached to the liquid supply unit.

2. The protection member according to claim 1, wherein when the terminal portion is viewed via the opening in a state where the protection member is attached to the liquid supply unit, at least apart of the engagement portion is located within a region formed by extending the opening in a direction from the sealing portion toward the liquid supply portion.

3. A protection member for attachment to a liquid supply unit including: a first partition wall having a supply hole that supplies a liquid to a liquid ejection apparatus; a second partition wall intersecting the first partition wall, the second partition wall having a terminal portion electrically connected to an electrical connection portion provided in the liquid ejection apparatus and having a first engaging portion that engages with the liquid ejection apparatus; and a third partition wall intersecting the first partition wall and opposed to the second partition wall, the third partition wall having a second and third engaging portions that engage with the liquid ejection apparatus respectively, the protection member comprising:

a bottom wall having a sealing portion that seals the supply hole;

a first side wall intersecting the bottom wall, the first side wall having a first engagement portion that engages with the first engaging portion, and having an opening provided in a portion opposed to the terminal portion so that at least a part of the terminal portion is exposed through the opening in a state where the protection member is attached to the liquid supply unit.

4. The protection member according to claim 3, further comprising:

a second side wall intersecting the bottom wall and opposed to the first side wall;

a second engagement portion that engages with the second engaging portion, the second engagement portion provided on the second side wall; and a third engagement portion that engages with the third engaging portion, the third engagement portion provided on the second side wall.

5. The protection member according to claim 3, wherein when the protection member is viewed in a plan view in a direction extending from the first side wall toward the second partition wall in a state where the protection member is attached to the liquid supply unit, at least a part of the first engagement portion is located within a region formed by extending the opening in a direction extending from the sealing portion toward the supply hole.

6. The protection member according to claim 5, wherein the distance from the sealing portion to the first engagement portion is longer than the distance from the sealing portion to the opening.

7. The protection member according to claim 3, wherein the first engagement portion, the second engagement portion, and the third engagement portion are arranged such that at least a part of the terminal portion is located in a region formed by connecting, using straight lines, the first engagement portion, the second engagement portion, and the third engagement portion to one another when the protection member is viewed in a plan view in a direction extending from the supply hole toward the sealing portion in a state where the protection member is attached to the liquid supply unit.

8. A liquid supply unit set comprising:

a liquid supply unit that supplies liquid to a liquid ejection apparatus, the liquid supply unit including:

a liquid containing portion that contains the liquid;

a liquid supply portion that supplies the liquid in the liquid containing portion to a liquid ejection apparatus;

a terminal portion electrically connected to an electrical connection portion provided in the liquid ejection apparatus;

an engaging portion that engages with the liquid ejection apparatus; and an atmosphere communication hole being in communication with the liquid containing portion;

a protection member attached to the liquid supply unit, the protection member includes:

a sealing portion that seals the liquid supply portion;

an engagement portion that engages with the engaging portion;

an operation portion for operating to release the engagement portion from the engaging portion; and an opening provided in a portion opposed to the terminal portion such that at least a part of the terminal portion is exposed through the opening in a state where the protection member is attached to the liquid supply unit; and a film material joined to the liquid supply unit to seal the atmosphere communication hole of the liquid supply unit, the film material also joined to the operation portion of the protection member.

9. The liquid supply unit set according to claim 8, wherein when the terminal portion is viewed via the opening in the state where the protection member is attached to the liquid supply unit, at least a part of the engagement portion is located within a region formed by extending the opening in a direction from the sealing portion toward the liquid supply portion.

10. The liquid supply unit set according to claim 8, wherein the position at which the film material is joined to the protection member is the same as the position at which the film material is joined to the liquid supply unit in a direction extending from the sealing portion toward the engagement portion when the terminal portion is viewed via the opening in a state where the protection member is attached to the liquid supply unit.

* * * * *